US005174174A

United States Patent [19]

Schroeder

[11] Patent Number: 5,174,174

[45] Date of Patent: Dec. 29, 1992

[54] INSTALLATION TOOL FOR RESTRICTOR PLATE IN SHOCK STRUT

[75] Inventor: Monte L. Schroeder, Enumclaw, Wash.

[73] Assignee: The Boeing Company, Seattle, Wash.

[21] Appl. No.: 820,306

[22] Filed: Jan. 13, 1992

[51] Int. Cl.[5] ..... B25B 33/00

[52] U.S. Cl. ..... 81/55; 294/106; 294/158

[58] Field of Search ..... 81/55, 13, 125; 294/1.1, 93, 106, 158, 117

[56] References Cited

U.S. PATENT DOCUMENTS

| | | | |
|---|---|---|---|
| 2,055,262 | 9/1936 | Queen . | |
| 2,235,572 | 3/1941 | Culbertson . | |
| 2,358,249 | 9/1944 | Portuondo . | |
| 2,374,582 | 4/1945 | Caldarelli . | |
| 3,170,232 | 2/1965 | Craver . | |
| 3,485,118 | 12/1969 | Maughan, Jr. . | |
| 3,587,271 | 6/1971 | Rigot . | |
| 3,889,558 | 6/1975 | Duncan . | |
| 4,334,443 | 6/1982 | Pearson | 81/55 |

FOREIGN PATENT DOCUMENTS 518070 2/1940 United Kingdom .

OTHER PUBLICATIONS

Diagram of installation tool-The Boeing Company Tool Drawing ME65B01211-1.

*Primary Examiner*—James G. Smith
*Attorney, Agent, or Firm*—Glenn D. Bellamy

[57] ABSTRACT

The present invention is a tool for installing a restrictor plate 14 in a shock strut cylinder 10. It includes a first tool member 12 having an elongated handle 24 with proximal 22 and distal 38 ends and a longitudinal axis. The distal end 38 includes a controllable attachment 25 for providing an axially-centered locking grasp on a restrictor plate 14. A first control 36 which is operable by a user from the proximal end 22 controls the attachment 25. The distal end 38 includes a pivoting head 40 for movement of the restrictor plate 14 between a first position which is in axial alignment with the handle 24 and a second position which is transverse to the axis of the handle 24. A second control 20 is operable by a user from the proximal end 22 to control the position of the pivot head 40. A second tool member 28 has a hollow elongated handle 32 with proximal 114 and distal 116 ends and is sized to axially telescope over the elongated handle 24 of the first tool member 12. The distal end 116 includes a cage assembly 34 for holding and positioning a retaining nut 30. The second tool member 28 includes a centering assembly 126, 128 which axially centers the tool member 28 within the shock strut cylinder 10 and includes bearings 136 which facilitate axial rotation of the hollow elongated handle 30 to the cage assembly 34, and the retaining nut 30 relative to the first tool member 12 and the shock strut cylinder 10.

8 Claims, 17 Drawing Sheets

36
58
56
20
92
90
86
98
22
12
88
94
84
60
24
82

36
56
58
60
20
90
98
86
84
82

INSTALLATION TOOL FOR RESTRICTOR PLATE IN SHOCK STRUT

DESCRIPTION

1. Technical Field

This invention relates to a two-piece tool for installing a restrictor plate and retaining nut in a shock strut cylinder. The first tool member moves and pivots the restrictor plate into place. The second tool member moves the retaining nut into position to thread it onto the plate.

2. Background of the Invention

In the construction of an "oleo" shook-absorbing strut, commonly used in commercial aircraft landing gear, it may be necessary to insert a restrictor plate within the shock strut cylinder at some distance beyond the open end of the cylinder. An example of a shook strut having such a construction is the outboard landing gear on the commonly-known Boeing 747 commercial airplane. Installation of the restrictor plate is required during initial construction and rebuild or refurbishment of the landing gear. Previously, this installation was performed with an awkward four-piece tool set which made the task very time consuming and at great risk of damage to the restrictor plate, nut or interior surface of the shook strut cylinder.

The shock strut cylinder has a precisely-milled interior surface. The interior diameter of a Boeing 747 outboard wing gear strut cylinder is slightly greater than twelve inches. At a point approximately sixty inches from its open end, the cylinder includes an annular lip. The restrictor plate must be seated at its perimeter against this annular lip on the side of the lip opposite the cylinder's opening. The restrictor plate is approximately the same diameter as the interior of the cylinder and includes diametrically-opposed flat portions such that, when aligned transversely, the restrictor plate can be moved past the annular lip and then rotated approximately 90° so that it is axially aligned within the cylinder. A retaining nut is threaded onto the restrictor plate on the opposite side of the annular lip to hold the restrictor plate in place.

The previously-used four-piece tool held the restrictor plate at two locations. The attachment included a frictionally fitting hub which fit into a central opening in the restrictor plate and included a radially-extending arm through which an attachment bolt extended and threaded into a hole at the outboard edge of the restrictor plate. This tool piece included a pivotally-mounted elongated handle and allowed the restrictor plate to freely pivot between first and second positions approximately 90° in orientation from one another and relative to the handle. A second handle was pivotally attached to the mounting arm radially outwardly from the first handle and radially inwardly from the connecting bolt. This assembly was then slid longitudinally into the open end of the shock strut cylinder on a Teflon (trademark) or nylon sled with the restrictor plate positioned diametrically in the cylinder. The sled was shaped to fit the interior bore of the cylinder and to cradle the first elongated handle of the tool. The sled also included an elongated handle which allowed manipulation of the sled from the open end of the shock strut cylinder.

Once the restrictor plate was moved past the annular lip within the cylinder, the plate would be shifted in orientation by pushing the second handle toward the restrictor plate while the first, central handle is pulled toward the cylinder opening. This rotated the restrictor plate into a 90° orientation, axially aligned within the cylinder for installation. The restrictor plate was then seated by pulling back on the first, central handle. At this stage of the installation, a problem commonly occurred. This problem was that, because this tool was firmly secured to the restrictor plate only at an outboard bolt hole location, the restrictor plate is likely to cook out of perpendicularity, making it difficult to properly seat the restrictor plate or to install the retaining nut without cross-threading. This problem, resulting in cross-threading of the plate and nut, has been known to occur up to in approximately 50% of installation attempts, requiring abandonment of the installation and scrapping of the ruined plate and nut.

To install the retaining nut, the second handle of the first tool had to be removed. This was because it was not axially centered and would interfere with installation of the retaining nut. This, however, left the user without any positive control over the angle of the restrictor plate except to apply more rearward force to the tool handle. Because of the offset mounting, this could compound the alignment problem. The retaining nut was placed on end locating prongs of a second tool which slid axially over the central handle of the first. This tool included Teflon or nylon slide bearings at its perimeter on which it was slid into the cylinder. The retaining nut was moved into place against the restrictor plate threads and rotated by movement of the second tool by hand until lightly tight, then torqued to 170–175 foot-pounds. The second tool was then pulled away from the retaining nut and removed from the cylinder.

The outboard clamping bolt on the first tool then had to be removed. This operation often proved to be extremely awkward as it involved the use of a wrench extension to reach the bolt approximately 64 inches down into the strut cylinder. This operation alone could often take up to an hour or more to successfully perform. If the bolt was dropped in cylinder after removal from the restrictor plate, damage could occur to the finely-milled interior surface of the cylinder. The first tool was then be pulled by its handle from the installed restrictor plate and slid on the previously-described sled.

The above-described procedure using these tools would take from two to eight hours or more to successfully complete and resulted in at least 10% scrappage of production parts due to cross-threading and incorrect installation. Use by a novice installer would normally require substantially more installation time and with a higher rate of scrappage.

SUMMARY OF THE INVENTION

The present invention provides a two-piece tool which is lightweight, easy to use, and reliable. Installation using the tool of the present invention can out installation time to as little as ten to twenty minutes, even by a novice installer, and virtually eliminates scrappage of parts.

The tool comprises a first member with an elongated handle having proximal and distal ends and having a longitudinal axis. The distal end includes a controllable attachment means for providing an axially-centered locking grasp on a restrictor plate. A first control means is provided which is operable by a user from the proximal end to control the attachment means. The distal end includes a means for pivoting the restrictor plate between a first position and a second position relative to the longitudinal axis. A second control means is provided which is operable by a user from the proximal end to control the pivoting means.

The tool includes a second member having a hollow elongated handle with proximal and distal ends and which is sized to axially telescope over the elongated handle of the first tool member. The distal end includes a cage means for holding and positioning a retaining nut. The second tool member also includes a centering means for axially centering the tool member within the shock strut cylinder and a bearing means for facilitating axial rotation of the hollow elongated handle, the cage means, and the retaining nut relative to the first tool member and the shook strut cylinder.

In preferred form, the first position of the restrictor plate is in axial alignment relative to the longitudinal axis of the first handle and the second position is axially transverse relative to this axis. When the pivoting means and restrictor plate is in the second position, the first control means may be locked from operation to prevent undesired release of the restrictor plate from the tool member.

Other aspects and features of the present invention will become apparent from a study of the drawing and description of the best mode for carrying out the invention, as well as the claims which are appended hereto, all of which make-up the disclosure of the present invention.

BRIEF DESCRIPTION OF THE DRAWINGS

Like reference numerals are used to indicate like parts throughout various figures of the drawing, wherein.

BEST MODE FOR CARRYING OUT THE INVENTION

Figure 1:
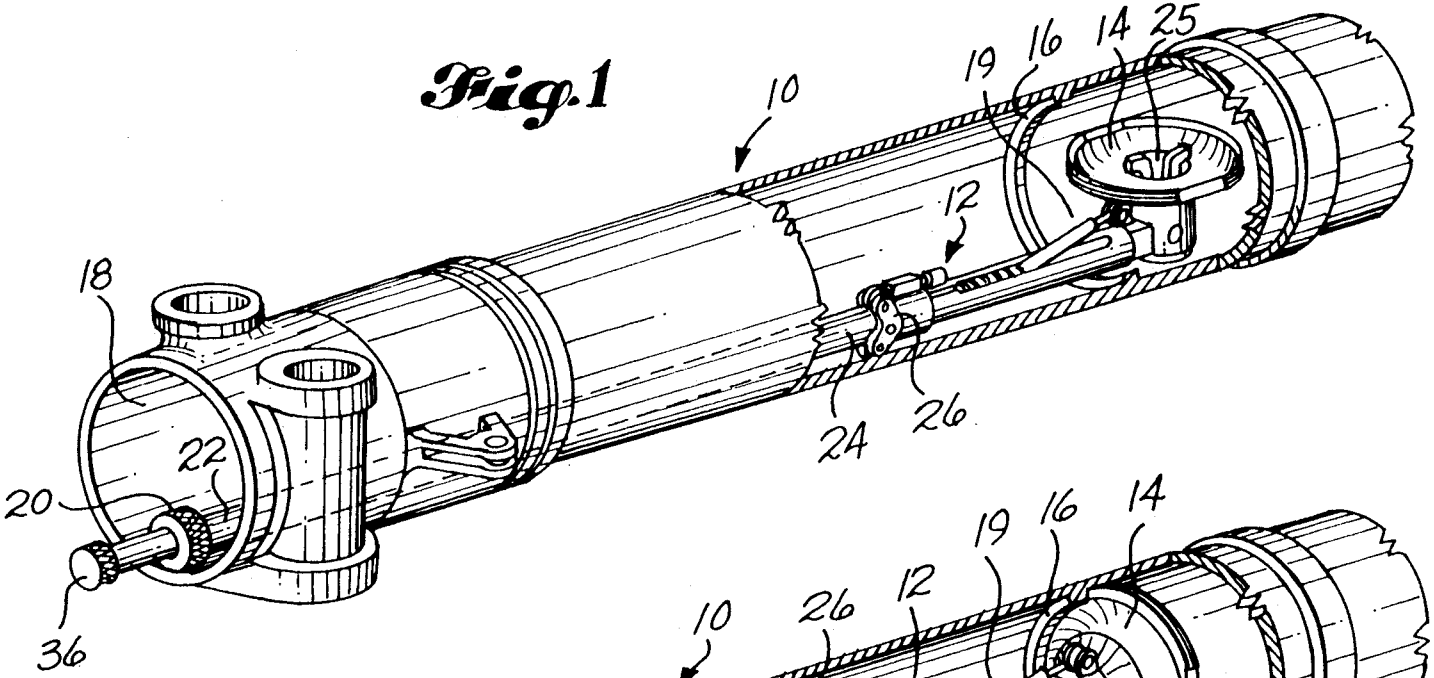
FIG. 1 is a fragmentary, partially cut-away pictorial view of a shock strut cylinder showing the restrictor plate being moved into the strut in a horizontal orientation.
Figure 2:
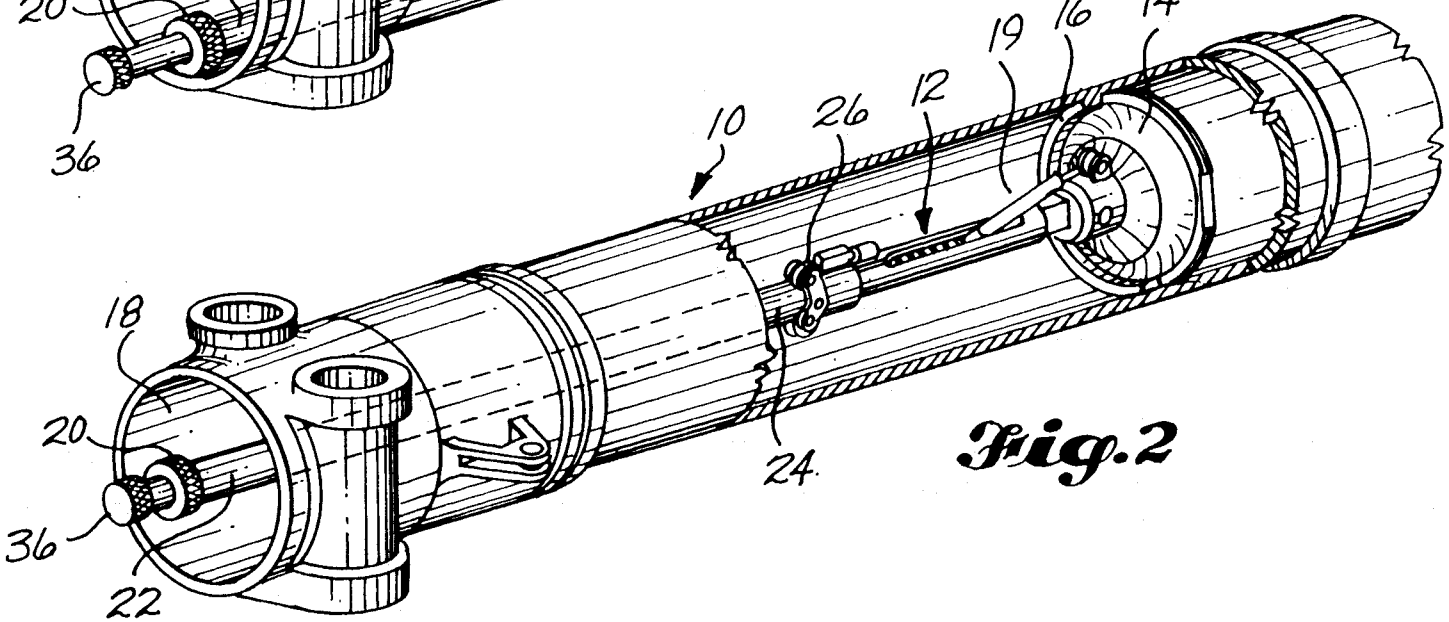
FIG. 2 is a view similar to FIG. 1, showing the restrictor plate pivoted into a vertical position and pulled into place against an annular lip inside the shook strut cylinder.

Referring to the various figures of the drawing, and first to FIGS. 1–4, therein is shown a partially out-away view of a horizontally-positioned, open-ended shook strut cylinder 10. FIG. 1 shows the first piece 12 of the tool of the present invention holding a restrictor plate 14 in a substantially horizontal position and positioned into the shock strut cylinder 10 beyond an internal annular bore lip 16. FIG. 2 shows the restrictor plate 14 having been rotated to a transverse position within the shock strut cylinder 10 and pulled toward the open end 18 of the cylinder 10. The position of the restrictor plate 14 is adjusted by a crosshead pivoting mechanism 19 and controlled by rotation of control knob 20 at the proximal end 22 of the first tool's handle 24. The first tool piece 12 is carried into the cylinder 10 on a roller carriage 26. This carriage 26 is positioned to allow the widest part of the restrictor plate 14 to be positioned (FIG. 1) approximately diametrically within the cylinder 10. As the restrictor plate 14 is moved into the transverse position (FIG. 2), the elongated handle 24 becomes axially aligned with the restrictor plate 14 and centered within the cylinder 10. The tool piece 12 of the present invention allows the restrictor plate 14 to be firmly seated against the annular bore lip 16 without risk of disengagement due to a positive locking mechanism 25. Also, proper seating and alignment of the restrictor plate 14 is assured because the angle of the plate 14 may be precisely adjusted remotely by the control knob 20 and because pulling force applied to the plate 14 is axially centered.

Figure 3:
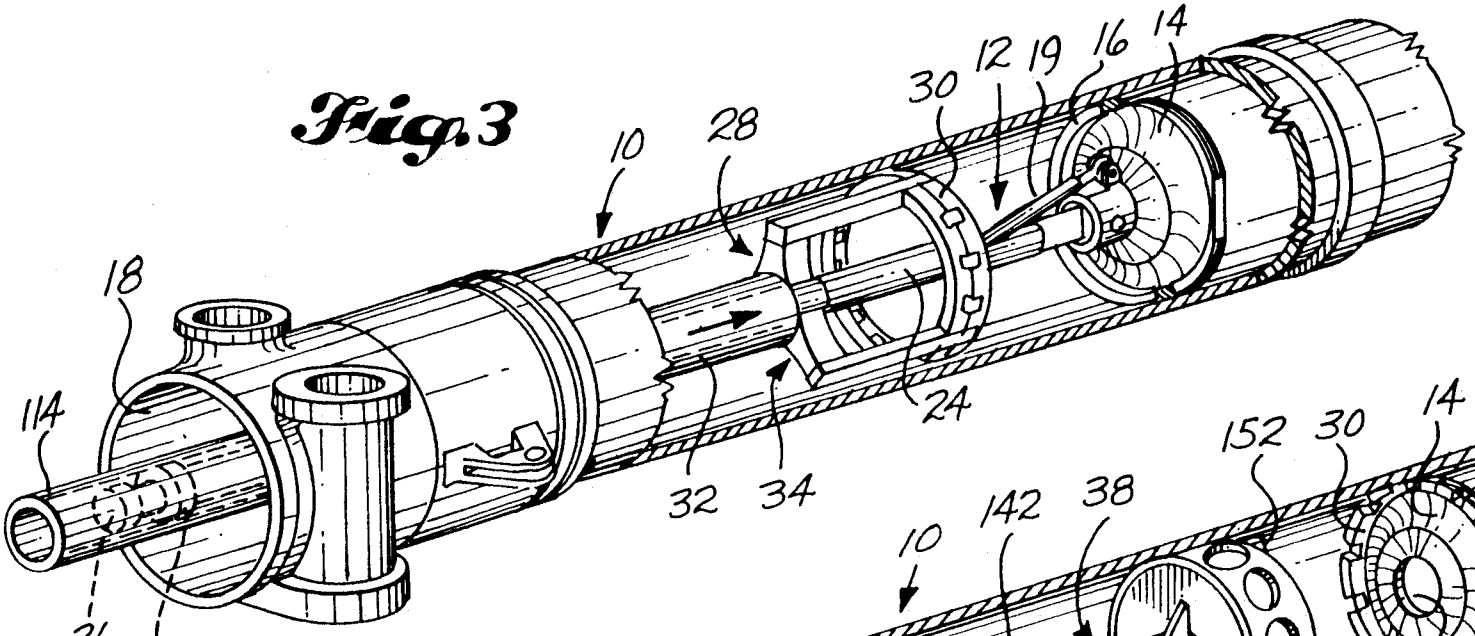
FIG. 3 is a view similar to Figs. 1 and 2, showing a second portion of the tool moving a restrictor nut into place to engage the restrictor plate.
Figure 21:
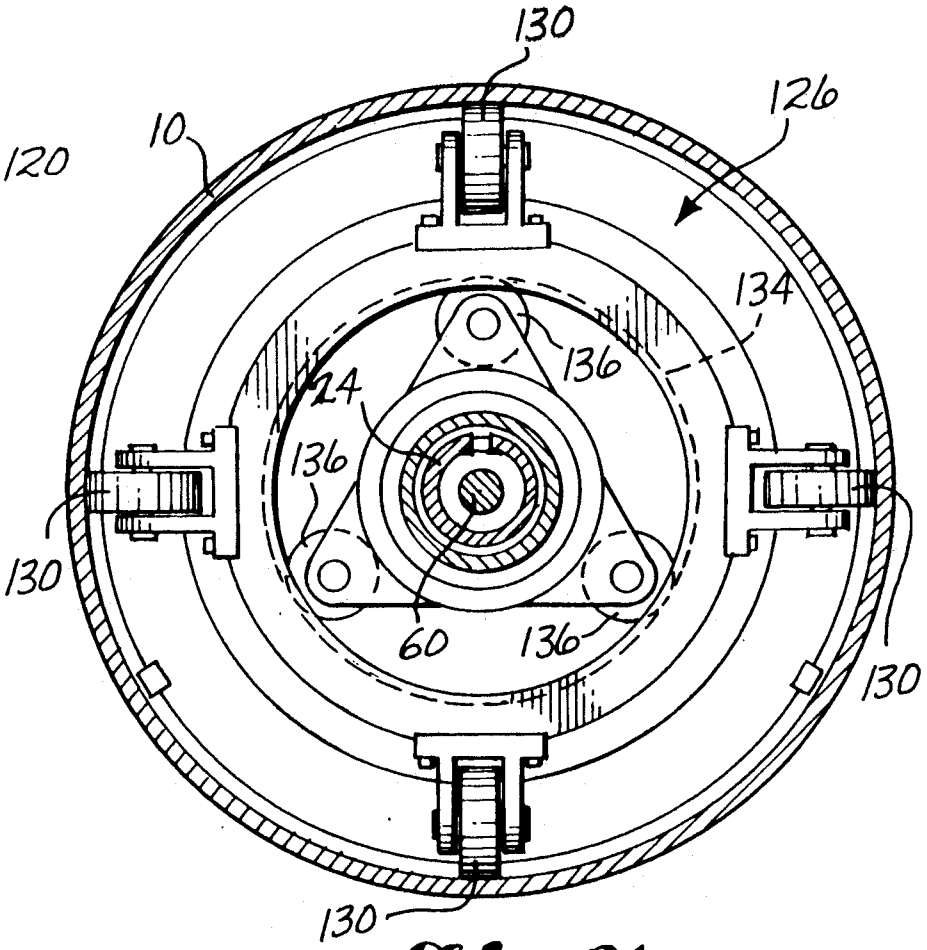
FIG. 21 is a sectional view taken substantially along line 21—21 of FIG. 19.

Referring now to FIG. 3, a second piece 28 of the tool of the present invention is used to insert and thread a retaining nut 30 onto peripheral threads of the restrictor plate 14. The second tool piece 28 includes an elongated, tubular handle 32 having a forked cage assembly 34 at its inward or distal end. The hollow handle portion 32 is sized to slide over the handle portion 24 of the first tool piece 12 and the forked cage is sized to provide clearance around the roller carriage 24 and crosshead pivoting mechanism 19 of the first tool member 12. The second tool member 28 mounts on two planetary roller housings which have outer periphery rollers sized to center the device axially within the cylinder 10. The planetary roller housings and periphery rollers are shown generally in FIGS. 16, 18 and 21. The second piece 28 of the tool is used to begin the engagement of the threads between the restrictor plate 14 and the retaining nut 30 and to tighten the engagement lightly tight only.

After the restrictor plate 14 and retaining nut 30 have been threaded together, the locking mechanism 25 of the first tool piece 12 and the restrictor plate 14 is released by rotation of the engagement control knob 36 at the proximal end 22 of the handle 24. The first tool member 12 is then free to be axially retracted from the restrictor plate 14 and the second tool part 28 can be separated from its frictional engagement with the retaining nut 30, also by axial movement. In preferred form, both tool parts 12, 28 are axially retracted together after disengagement from the restrictor plate 14.

Figure 4:
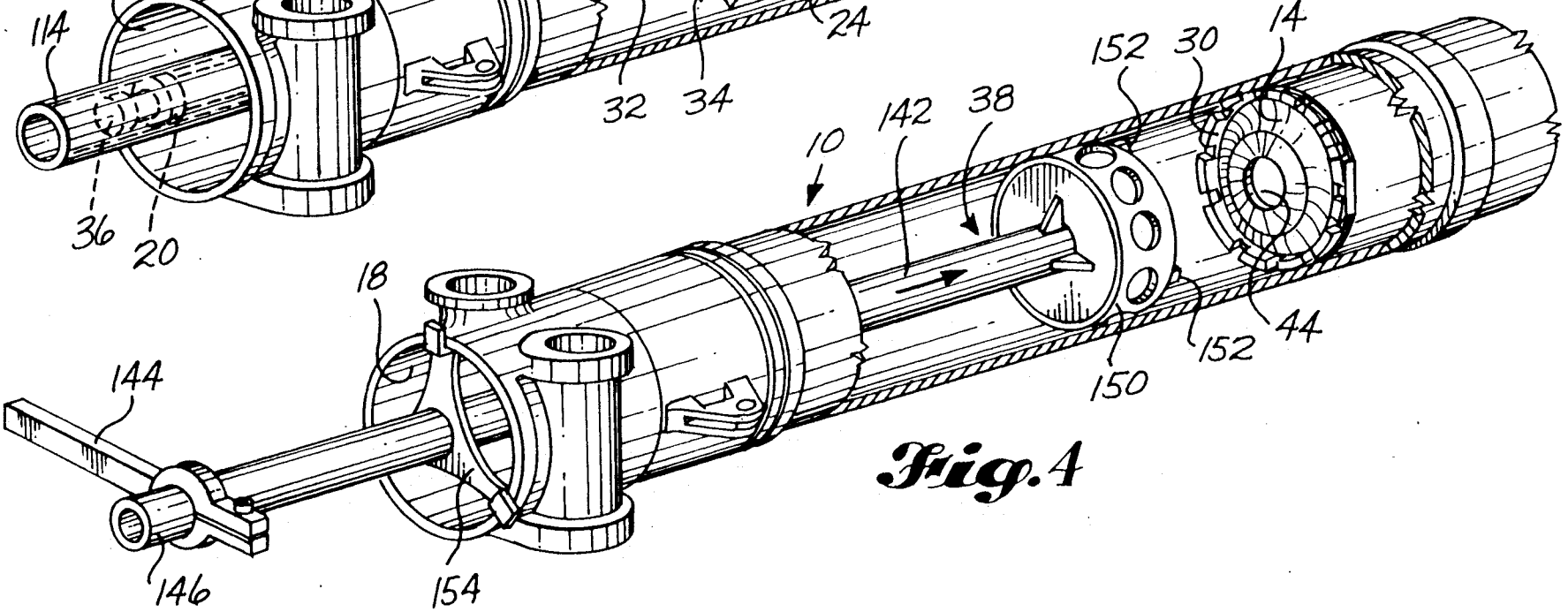
FIG. 4 shows a previously existing tool being moved into place for torquing the restrictor nut.

Referring to FIG. 4, after the retaining nut 30 has been lightly threaded onto the restrictor plate 14 and the tool parts 12, 28 of the present invention have been removed from the cylinder 10, a torquing wrench 38, such as may have previously been used for installation of the retaining nut 30, is used to tighten the engagement of the retaining nut 30 to the desired torque. For the previously-described Boeing 747 outboard landing gear shook strut, the desired torque is 170 to 175 foot-pounds.

Making reference to the remaining figures of the drawing, the construction and use of the installation tool of the present invention will be described in greater detail.

Construction and Use of the First Tool Piece

Figure 25:
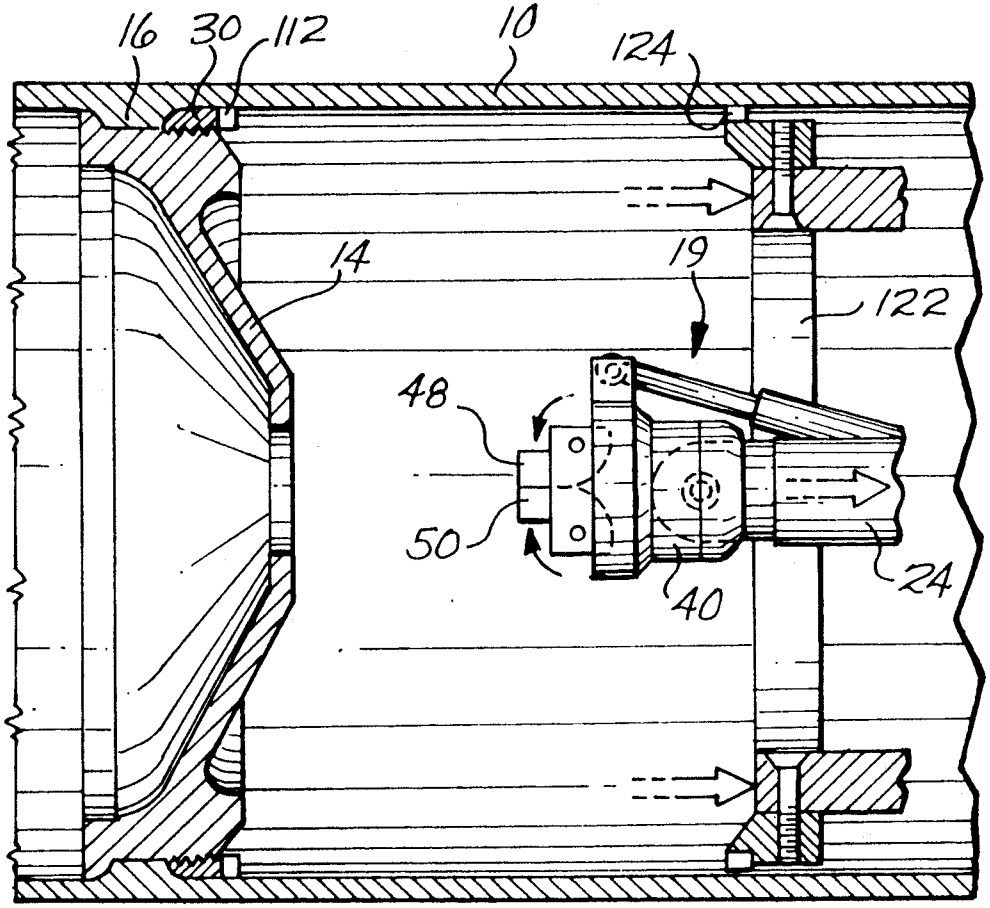
FIG. 25 is a detailed view similar to FIG. 20 showing the attachment jaws of the tool's first portion retracted and both portions of the tool being moved away from the seated and threaded restrictor plate and nut.
Figure 27:
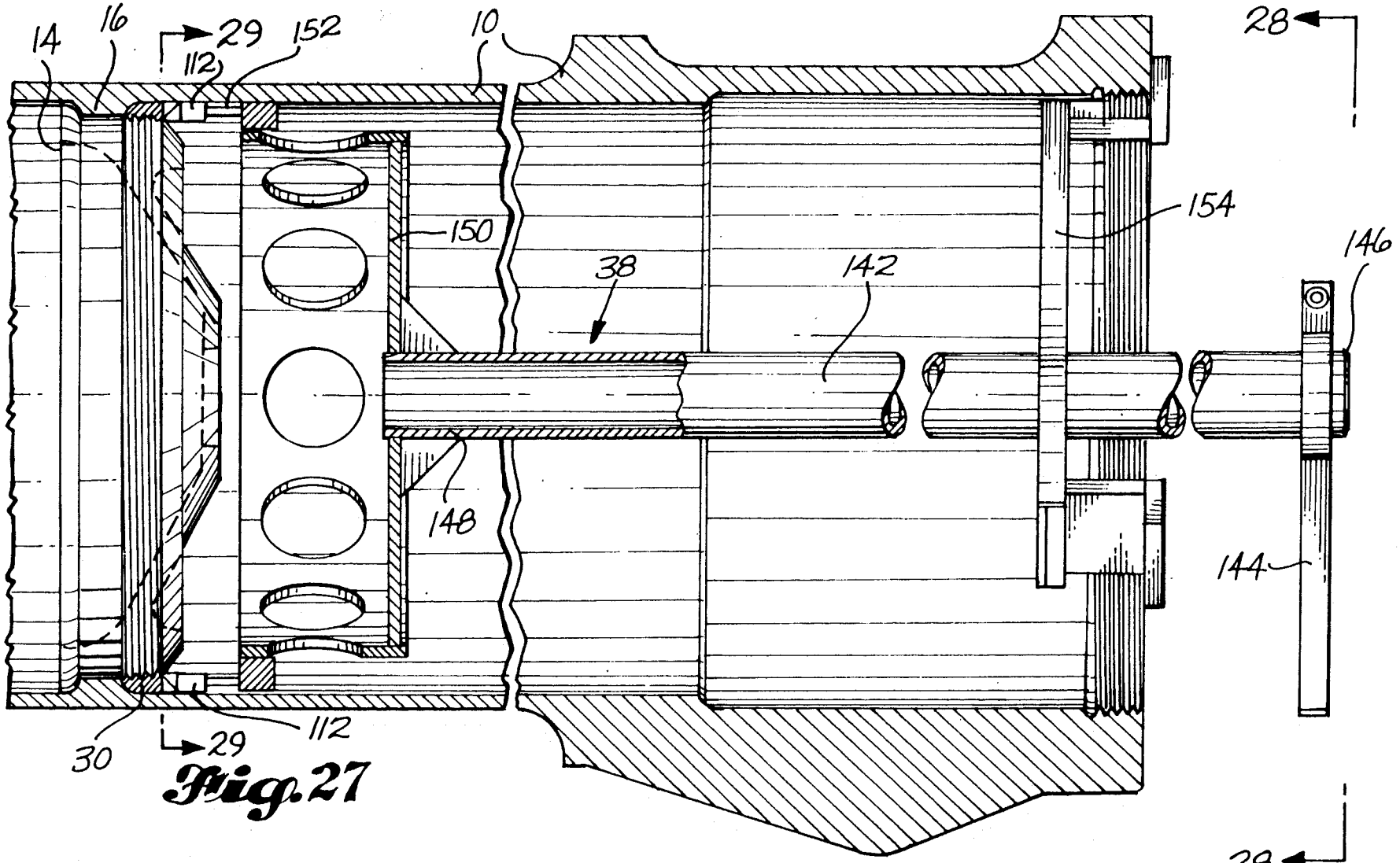
FIG. 27 is a broken sectional view of the shock strut cylinder showing a partially-sectioned view of a previously existing tool in place for torquing the restrictor nut onto the restrictor plate.
Figure 29:
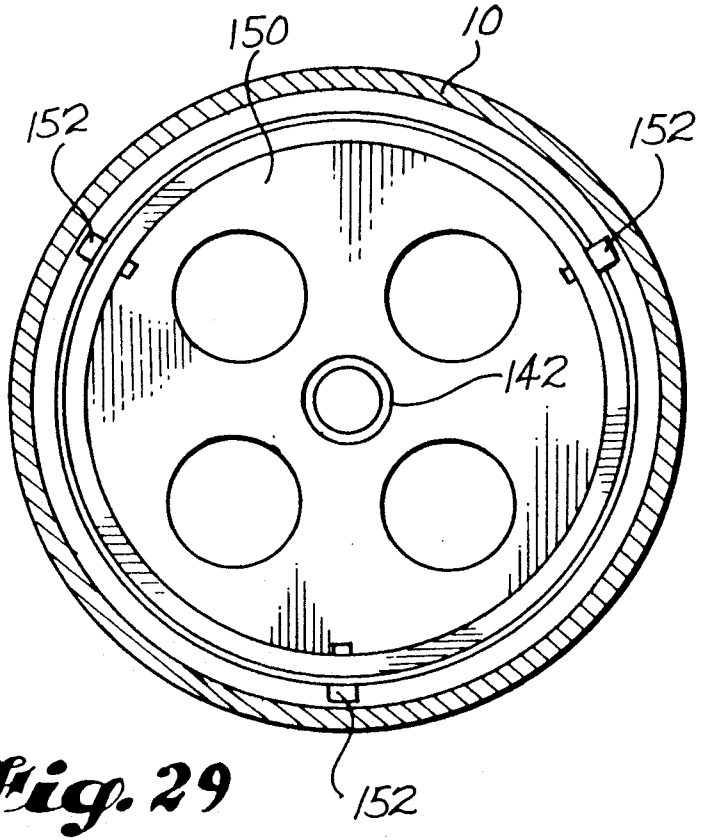
FIG. 29 is a sectional view taken substantially along line 29—29 of FIG. 27.
Figure 28:
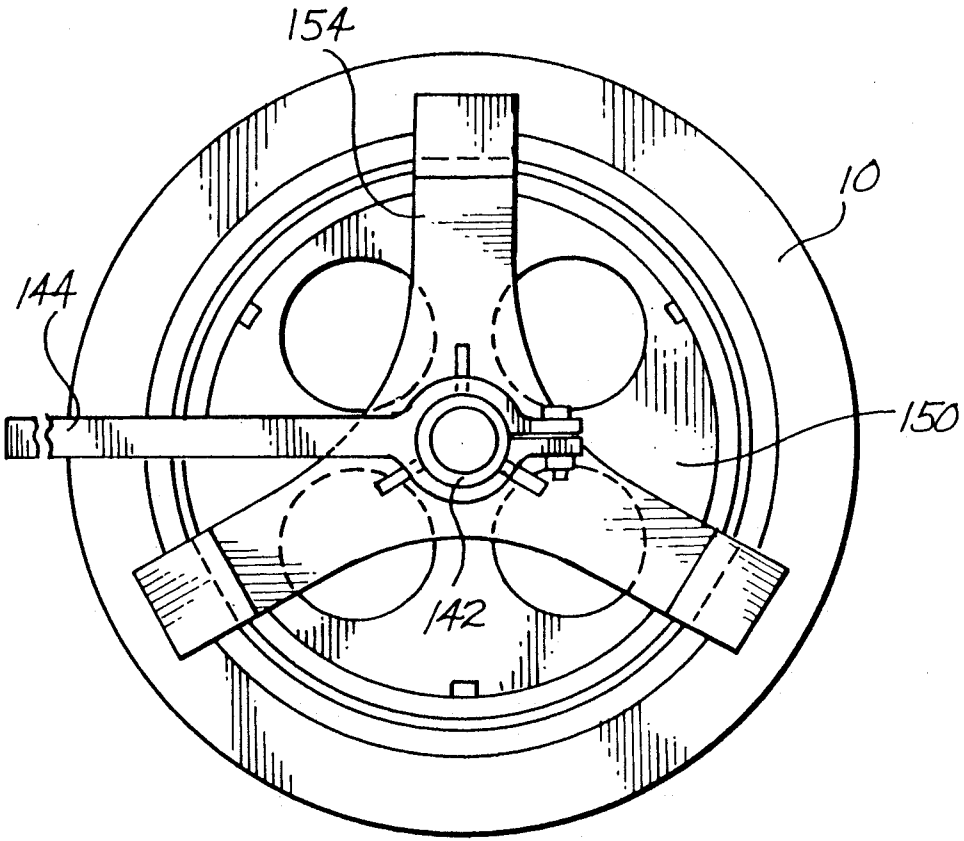
FIG. 28 is a sectional view taken substantially along line 28—28 of FIG. 27.

At the distal end 38 of the handle 24 of the first tool piece 12 is the restrictor plate looking or engagement mechanism 25 and the adjustable crosshead pivoting mechanism 19. These are shown specifically in FIGS. 5 and 6. At the proximal end 22 of the handle 24 is a first control knob 20 which operates the crosshead pivoting mechanism 19 and a second control knob 36 which operates the plate engagement mechanism. The looking mechanism 25 is operable only when the pivotal head 40 of the tool 12 is in the position shown in FIGS. 5 and 6. The head 40 includes a reduced diameter external nose pilot 42 which is sized to fit closely but easily into a central opening 44 in the restrictor plate 14. The head 40 also includes an annular shoulder 46 against which the restrictor plate 14 is firmly and positively clamped by pivoting jaw members 48, 50. The jaw members 48, 50 pivot about pins 52 and are shaped to retract to a position within the diameter of the nose pilot 42. A threaded plunger 54 mounted within the head portion 40 determines the position of the jaws 48, 50. In preferred form, the jaws 48, 50 are biased by a spring means (not shown) into a retracted position, as shown in FIG. 25. The threaded plunger 54 presses against base portions of the jaws 48, 50 to move them into the engaging position shown in FIGS. 5 and 6. When the plunger 54 is rotated counterclockwise, it retracts from the base portions of the jaws 48, 50, allowing them to move to a retracted position.

Figures 8, 9:
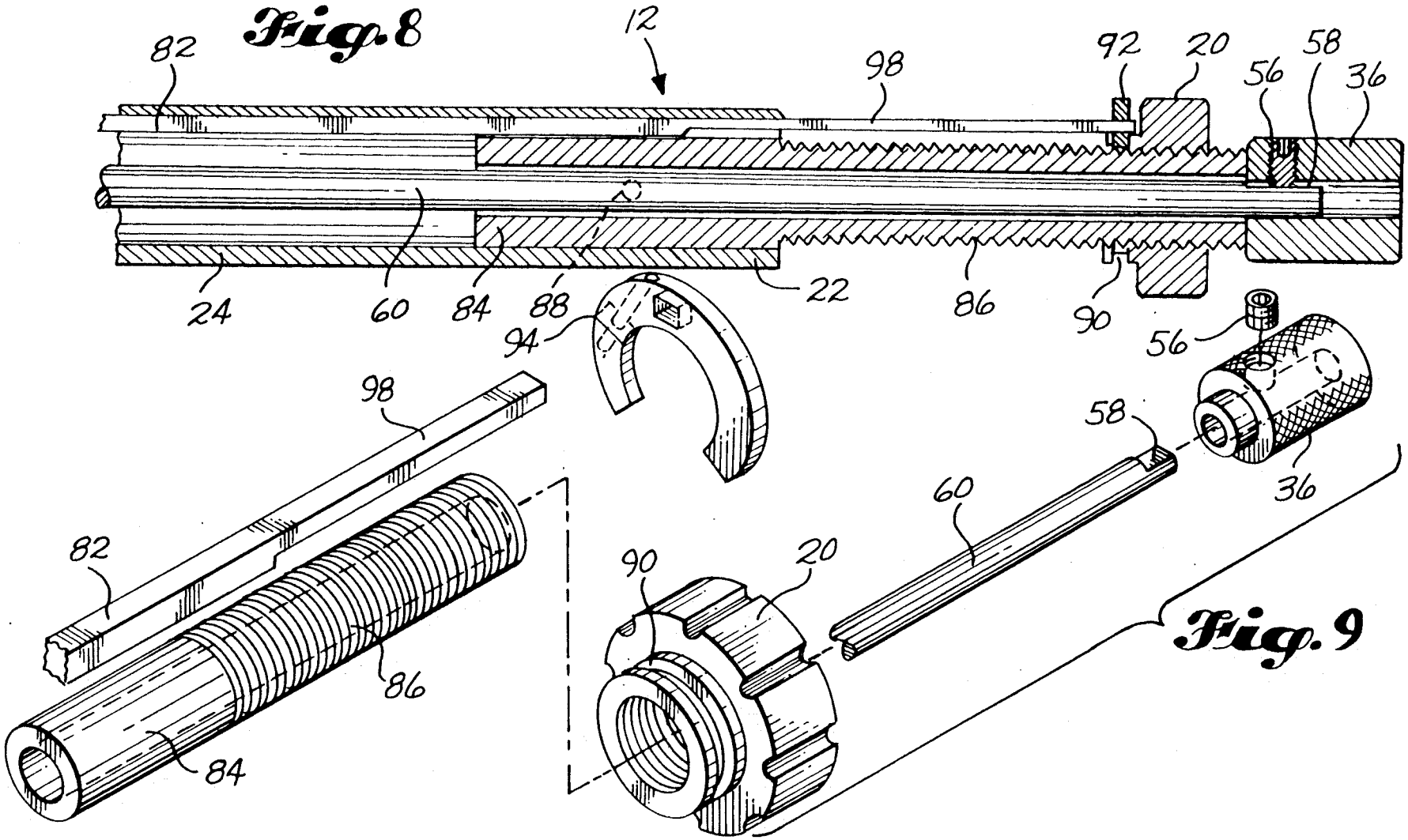
FIG. 8 is a fragmentary sectional view of the control means for positioning the angle of the restrictor plate on the tool.
FIG. 9 is an exploded view of the control means assembly.
Figure 10:
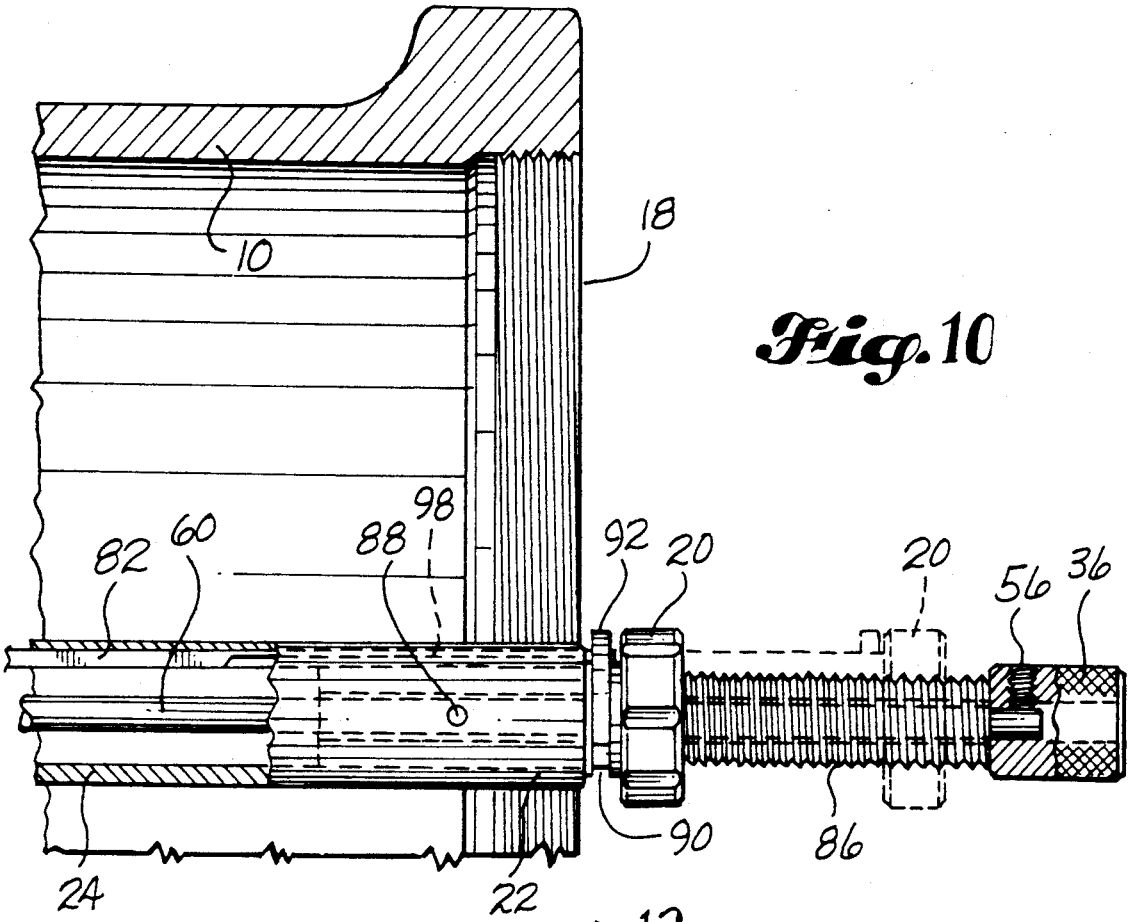
FIG. 10 is a fragmentary view showing relative positions of the first control knob as the tool is in use within the shock strut cylinder.

Referring to FIGS. 8, 9 and 10, the threaded plunger 54 can be operated remotely by rotation of the second control knob 36. The second control knob 36 is attached by means of a set screw 56 which bears against a flat 58 on the end of a control rod 60. The control rod 60 extends axially through the hollow interior of the handle 24 the full length from the proximal end 22 to the distal end 38. The control rod 60 is connected to the threaded plunger 54 through a universal joint 62. The function of the universal joint 62 is to allow the threaded plunger 54 to be driven by the second control knob 36 and control rod 60 while allowing the head portion 40 to pivot at an end axis 64 with which the universal joint 62 is aligned. When the head portion 40 is pivoted by the crosshead pivoting mechanism 19 to a position 90° relative to that shown in FIGS. 5 and 6, the universal joint 62 becomes locked and will not allow rotation of either the threaded plunger 54, the control rod 60, or the second control knob 36. As will be explained in more detail later, this limitation is a benefit because it is not necessary that the position of the jaws 48, 50 be controlled except when the head 40 is axially aligned with the handle 24 and such limitation provides a safeguard to prevent unintentional operation of the control jaws 48, 50 which could be detrimental at other times.

Once the restrictor plate 14 has been securely attached to the tool 12, the plate 14 and pivoting head 40 must be rotated to a position approximately 90° from the longitudinal axis of the handle 24. The head 40 is pivoted about its axis 64 by the crosshead pivoting mechanism 19. Movement of the head 40 is controlled at the proximal end 22 of the handle 24 by the first control knob 20. The crosshead pivoting mechanism 19 includes an adjustable-length linkage 66 which is pivotally connected 68, 70 at opposite ends to an upwardly-extending clevis portion 72 of the pivoting head 40 and to a clevis-like slot in a slide member 74.

Figure 5:
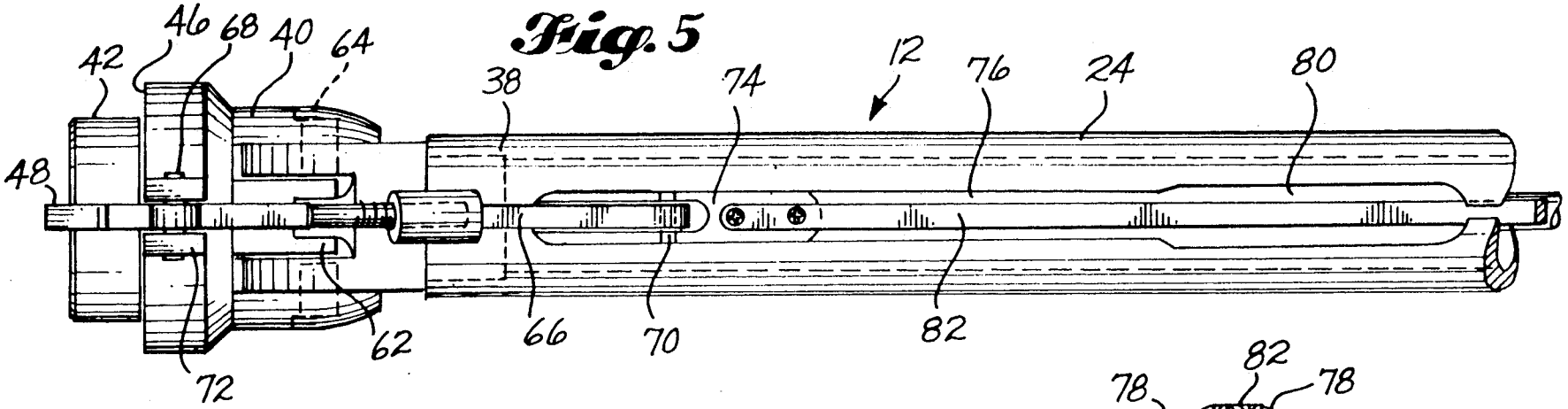
FIG. 5 is a detailed top plan view of the distal end of the first tool member.
Figure 7:
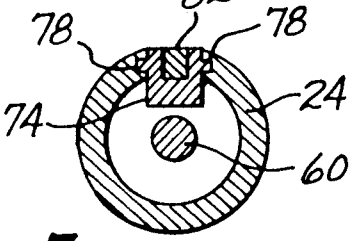
FIG. 7 is a sectional view taken substantially along line 7—7 of FIG. 6.
Figure 6:
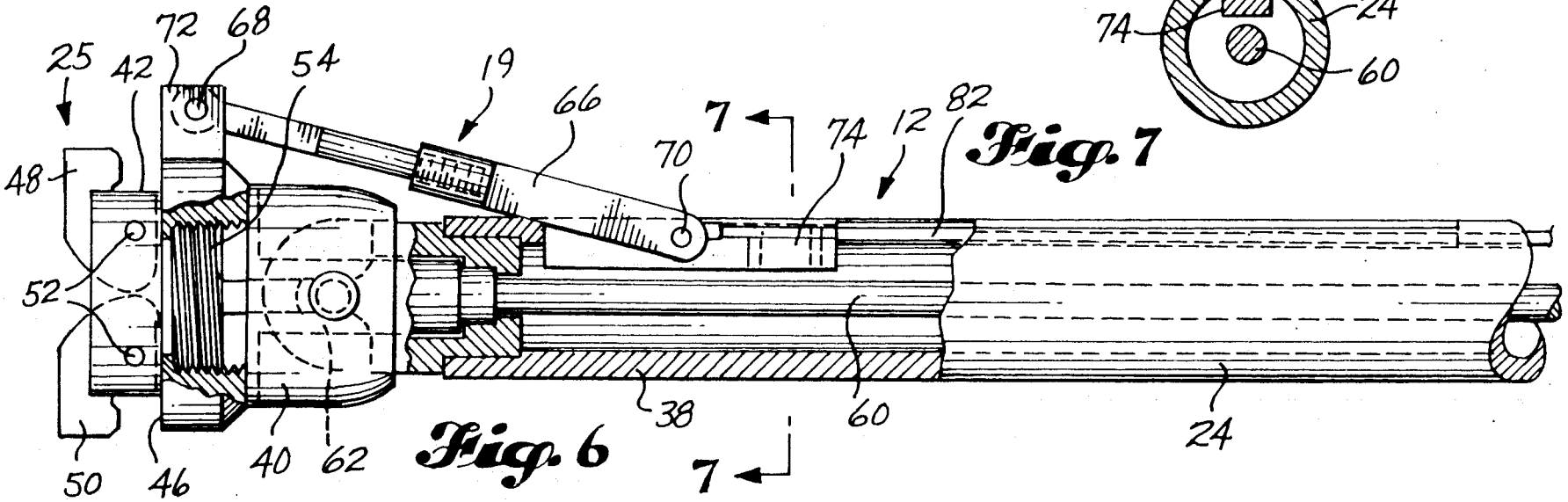
FIG. 6 is a partially cut-away side elevational view of the distal end of the first tool member.

Referring to FIGS. 5, 6 and 7, the slide member 74 is mounted to reciprocate within a slot 76 formed longitudinally in the handle 24. The slide 74 includes longitudinally-extending lateral tongues 78 which fit within lateral grooves of the slot 76. Toward the proximal end of the slot 76 is a key opening 80 which is beyond the normal range of reciprocation of the slide member 74. This opening 80 is provided for insertion of the slide 74 into the slot 76 prior to connection with the adjustable link 66. Movement of the slide member 74 causes movement of the adjustable link 66, resulting in pivoting of the head portion 40 about its axis 64. Range of motion of the pivoting head 40 beyond an axially aligned position is prevented by the slide member 74 reaching its extreme limit as shown in FIGS. 5 and 6.

Positioning of the slide member 74 is controlled remotely by a control bar 82 attached to the slide member 74 and extending longitudinally along the length of the handle 24. In preferred form, the handle 24 is provided with a groove sized to receive the control bar 82 within its radius.

Figure 11:
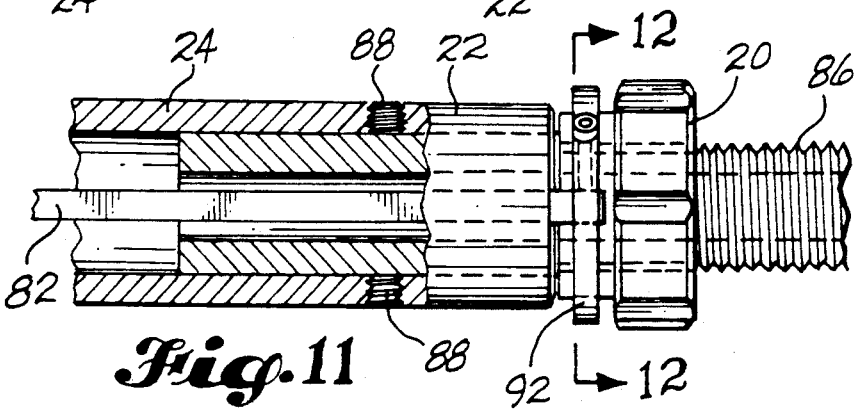
FIG. 11 is a partially out-away top plan view of the portion shown in FIG. 8.
Figure 12:
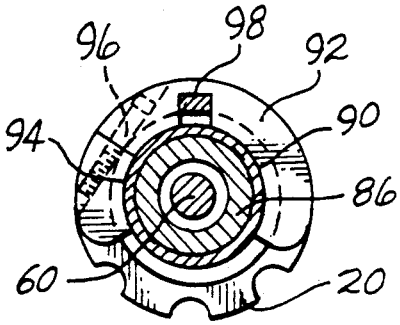
FIG. 12 is a sectional view taken substantially along line 12—12 of FIG. 8.

Referring to FIGS. 8–12, the control bar 82 is operated by the user at the proximal end 22 of the handle 24. In preferred form, a reduced diameter extension piece 84 having a threaded portion 86 is attached as an extension of the proximal end 22 of the handle 24. The extension piece 84 may be sized to partially fit within the hollow handle 24 and may be attached by set screws 88 or, alternatively, by roll pins which extend through openings in both the handle 24 and the extension piece 84 (not shown). The extension piece 84 could be threadedly engaged into the handle 24, although this is not recommended due to the torsional forces which are carried between the extension piece 84 and the handle 24. The first control knob 20 is threaded onto the threaded portion 86 with a range of travel substantially equivalent to the required range of travel of the slide member 74. The control knob 20 includes an integral annular groove 90 which is sized and shaped to receive a horseshoe collar 92. Referring especially to FIGS. 9 and 12, it can be seen that the horseshoe collar 92 encompasses slightly greater than 180° of the circumference of the groove 90, thereby preventing its displacement but allowing rotation of the control knob 20. In preferred form, the horseshoe collar is divided (at 94) and assembled by a set screw 96 to allow assembly and disassembly of the collar 92 on the knob 20. The division 94 of the collar 92 separates it into two components each encompassing less than 180° of the circumference of the groove 90.

A rear tongue portion 98 of the control bar 82 is sized to clear the threaded portion 86 of the extension member 84 and the groove 90 of the first control knob 20. This tongue portion 98 is attached to the horseshoe collar 92 by soldering or otherwise.

When the first control knob 20 is in the position shown in FIG. 11 and in solid lines in FIG. 10, the pivotal head 40 is positioned as shown in FIGS. 5 and 6. When the control knob 20 is rotated to move it along the threaded extension 86, it pulls with it the horseshoe collar 92 and, in turn, the control bar 82. When the control knob 20 is in the position shown in FIG. 8 and in phantom lines in FIG. 10, the slide member 74 is retracted and the pivotal head 40 is rotated to a position substantially as shown in FIGS. 1 and 13.

Figure 13:
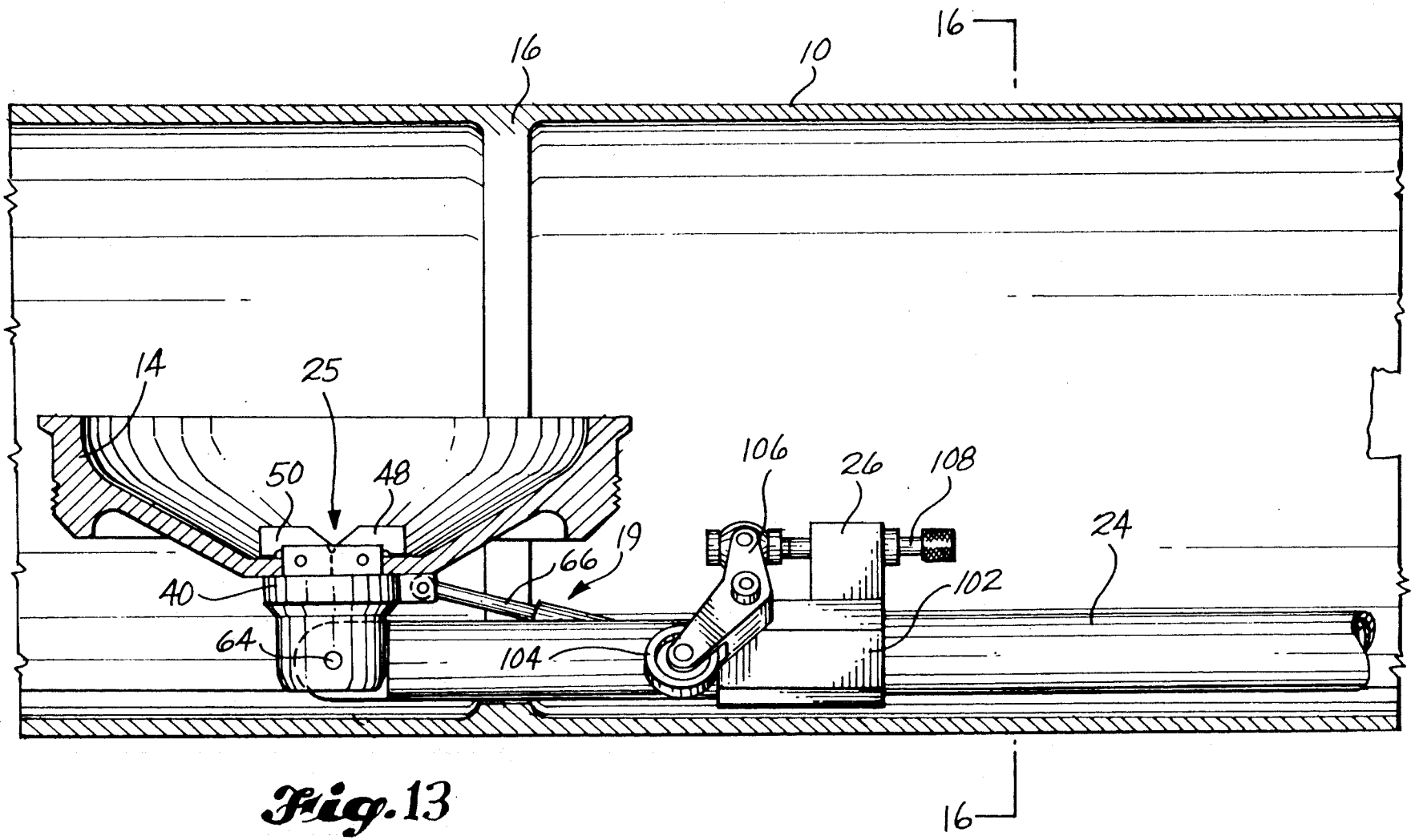
FIG. 13 is a fragmentary, partially-sectioned detail view of the restrictor plate being moved into place within the shock strut cylinder in a horizontal orientation.
Figure 14:
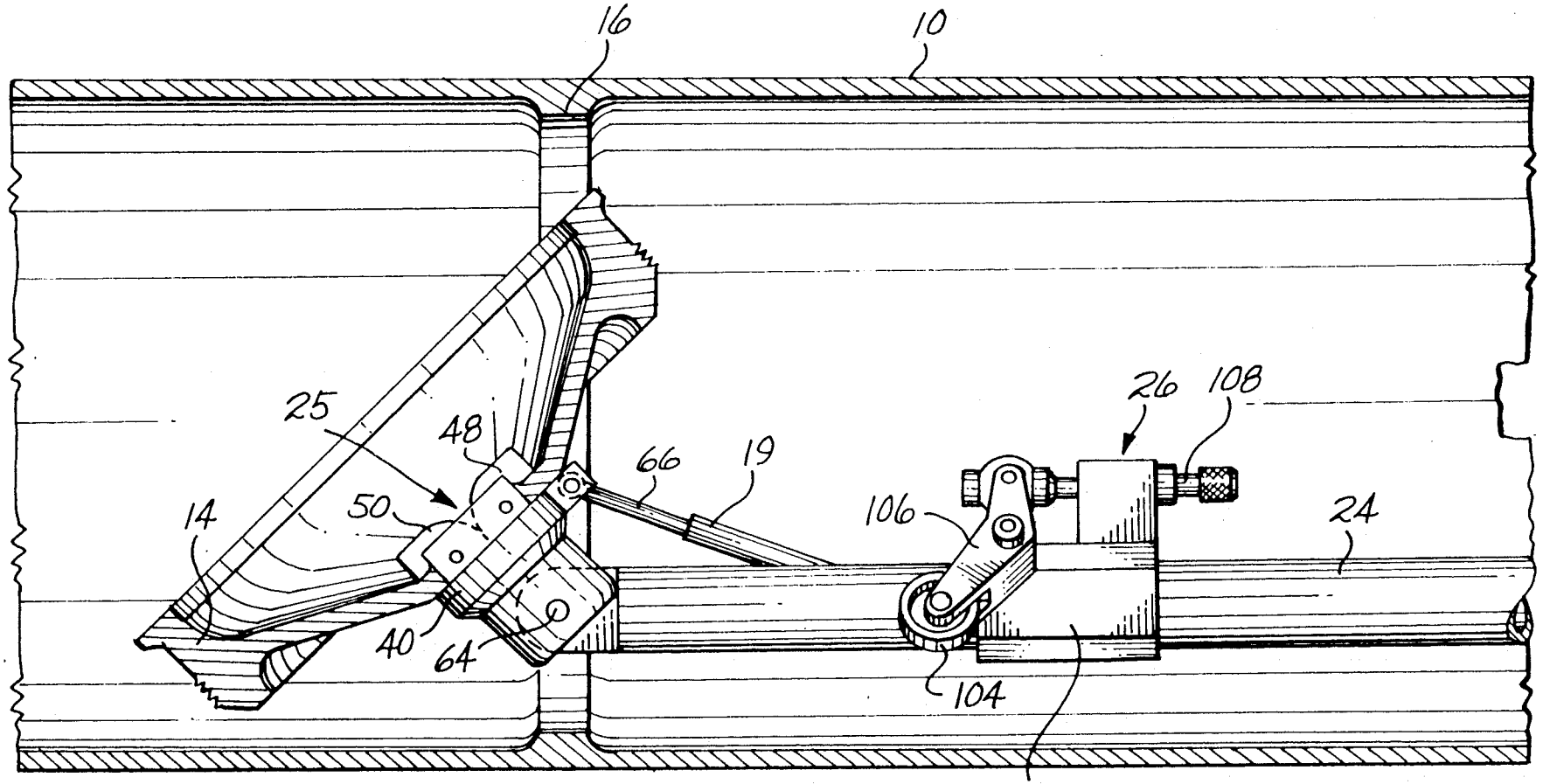
FIG. 14 is a view similar to FIG. 13, showing the restrictor moved from the horizontal orientation toward a vertical orientation.
Figure 15:
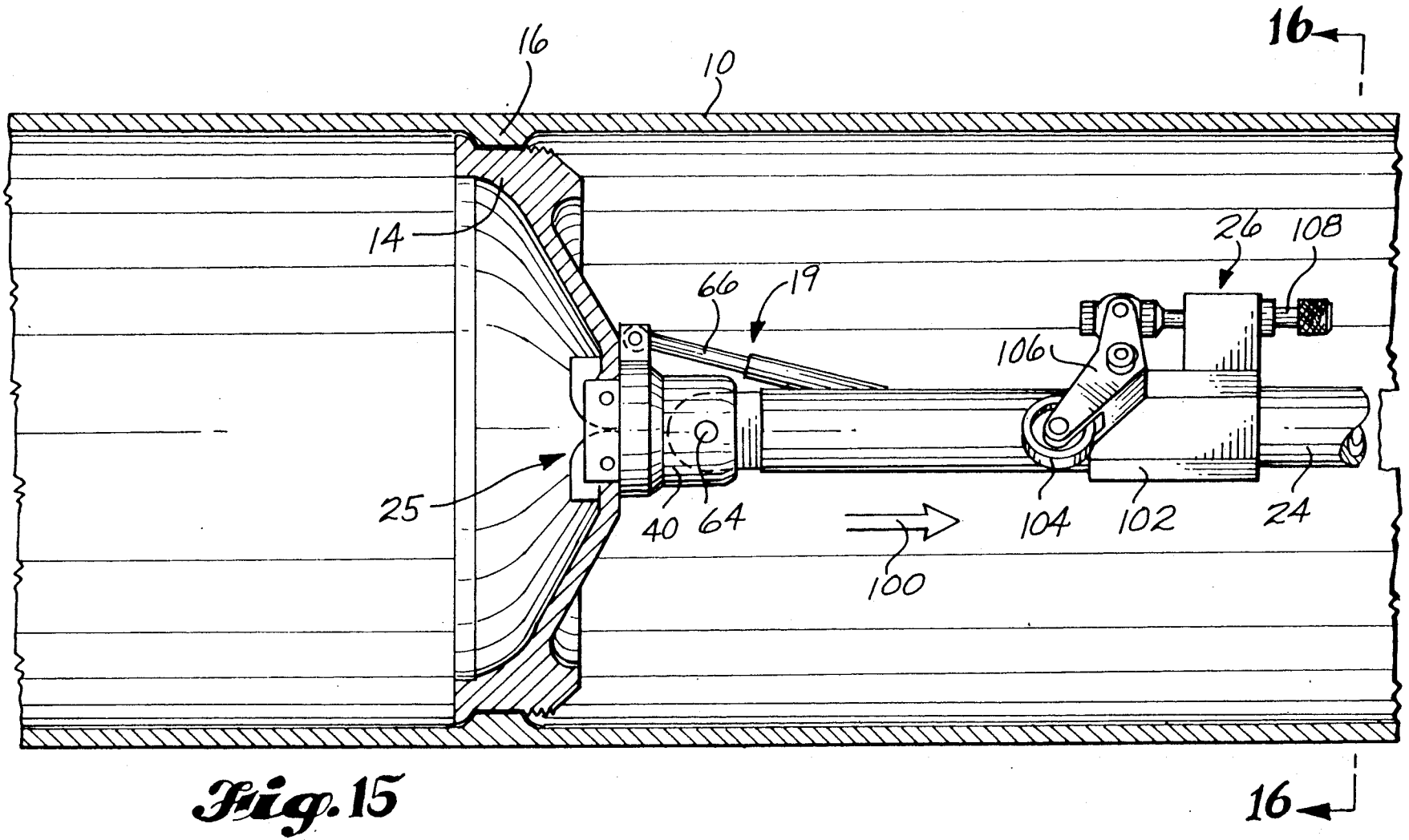
FIG. 15 is a view similar to Figs. 13 and 14, showing the restrictor plate moved into the vertical orientation and seated against the annular lip.

Referring now to Figs. 13–15, after the restrictor plate 14 has been attached to the pivotal head 40 of the tool piece 24 and the pivotal head subsequently tilted to the position shown in FIG. 13, it may be inserted into the open end 18 of the shook strut cylinder 10. As shown, the restrictor plate 14 includes diametrically-opposed flats allowing it to pass by the annular bore lip 16 when it is positioned centrally and transverse to the longitudinal axis of the cylinder 10.

As previously described, the first tool piece 12 and the restrictor plate 14 is carried into the cylinder 10 on a carriage assembly 26. This assembly 26 will be described in greater detail below. When the restrictor plate 14 has reached a position beyond the annular lip bore 16, as shown in FIG. 13, the restrictor plate 14 is then rotated to an axial position. Rotation of the restrictor plate 14 is shown in FIG. 14. The plate 14 is rotated by operation of the first control knob 20 at the proximal end 22 of the handle 24, as described above. As the control knob 20 is threaded forwardly, the crosshead pivoting mechanism 19 operates to move the pivoting head 40 through the position shown in FIG. 14 to an axially-aligned position shown in FIG. 15. Exact axial alignment of the restrictor plate 14 within the cylinder 10 is assured by fine adjustment of the adjustable linkage 66. As the restrictor plate 14 and head 40 are pivoted, the handle 24 is lifted as shown in FIG. 14 until it reaches an axially-centered position, as shown in FIG. 15. Once the restrictor plate is properly aligned, it is seated against the annular lip bore 16 by a rearward pull on the handle 24 in the direction shown by movement arrow 100 in FIG. 15.

Figure 16:
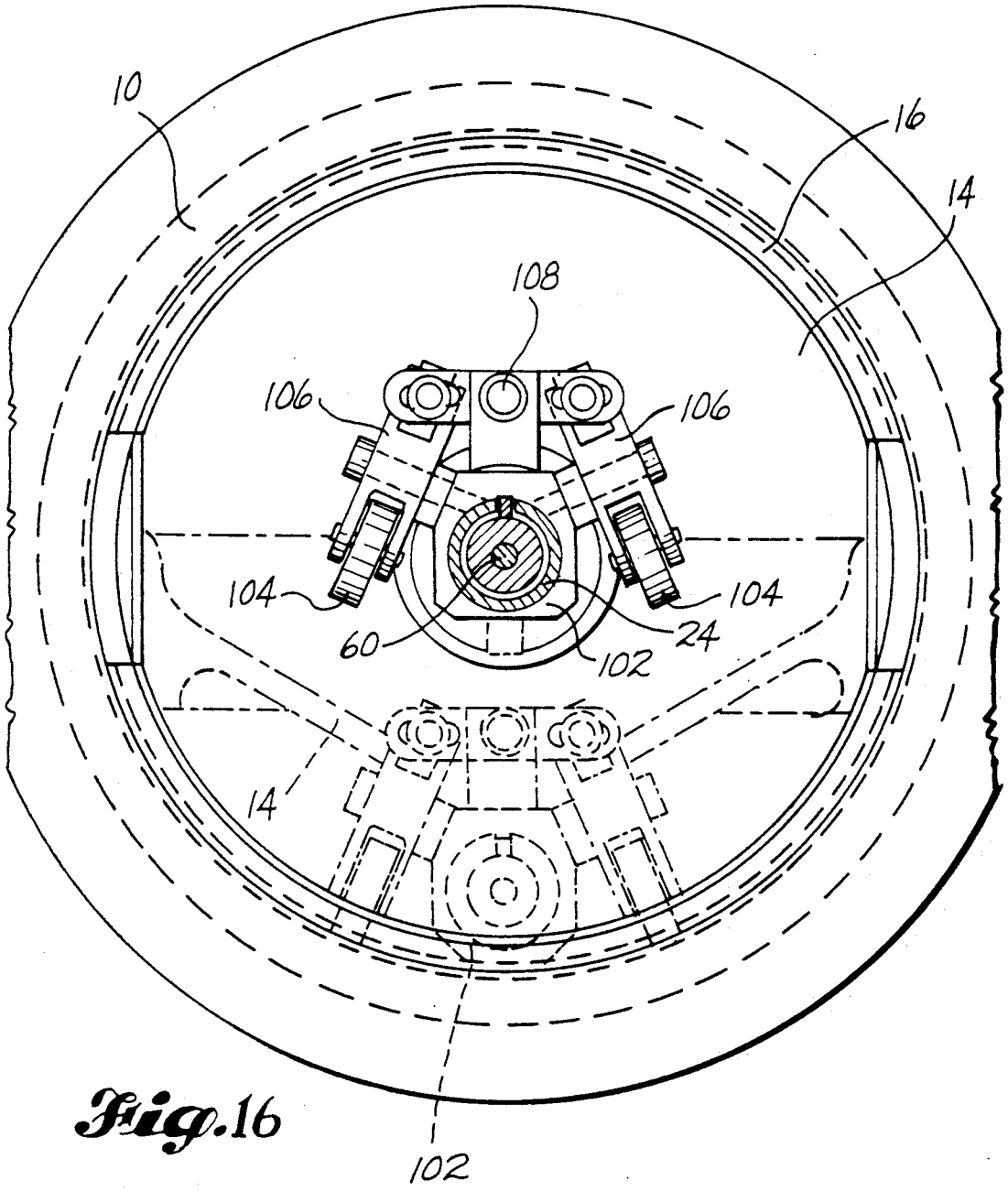
FIG. 16 is a cross-sectional view taken substantially along line 16—16 of FIG. 15 showing the restrictor plate in a seated position in solid lines and a sectional view taken substantially along line 16—16 of FIG. 13 showing the position of the plate and first tool member in phantom line.

Referring in particular to FIGS. 15 and 16, therein is shown a preferred construction of the roller carriage 26. The carriage 26 comprises a body 102 which is slidably attached to the handle 24. The body should be fixed in position by means of set screws or otherwise (not shown) when the tool piece 12 is in use. However, it is preferred that the roller carriage assembly 26 be positionable as desired along the handle 24 in order to provide proper balance of the tool 12 and to accommodate individual preferences of the user. The roller carriage 26 includes two adjustable roller wheels which are mounted to contact inner walls of the cylinder 10 at a radial angle. The roller wheels 104 are each carried by centrally-pivoted lever arms 106 mounted on the body 102. The lever arms are interlooked at the ends opposite the roller wheels 104. The lever arms 106 are adjustable by means of an adjustment screw 108. This allows fine adjustment of the vertical position of the tool piece 12 and the restrictor plate 14 as it travels down the center line of the cylinder 10 for insertion of the plate 14 past the annular rim bore 16. In preferred form, the roller wheels 104 are made of a non-marring material such as nylon or other thermoplastic material.

Construction and Use of the Second Tool Piece

Figure 17:
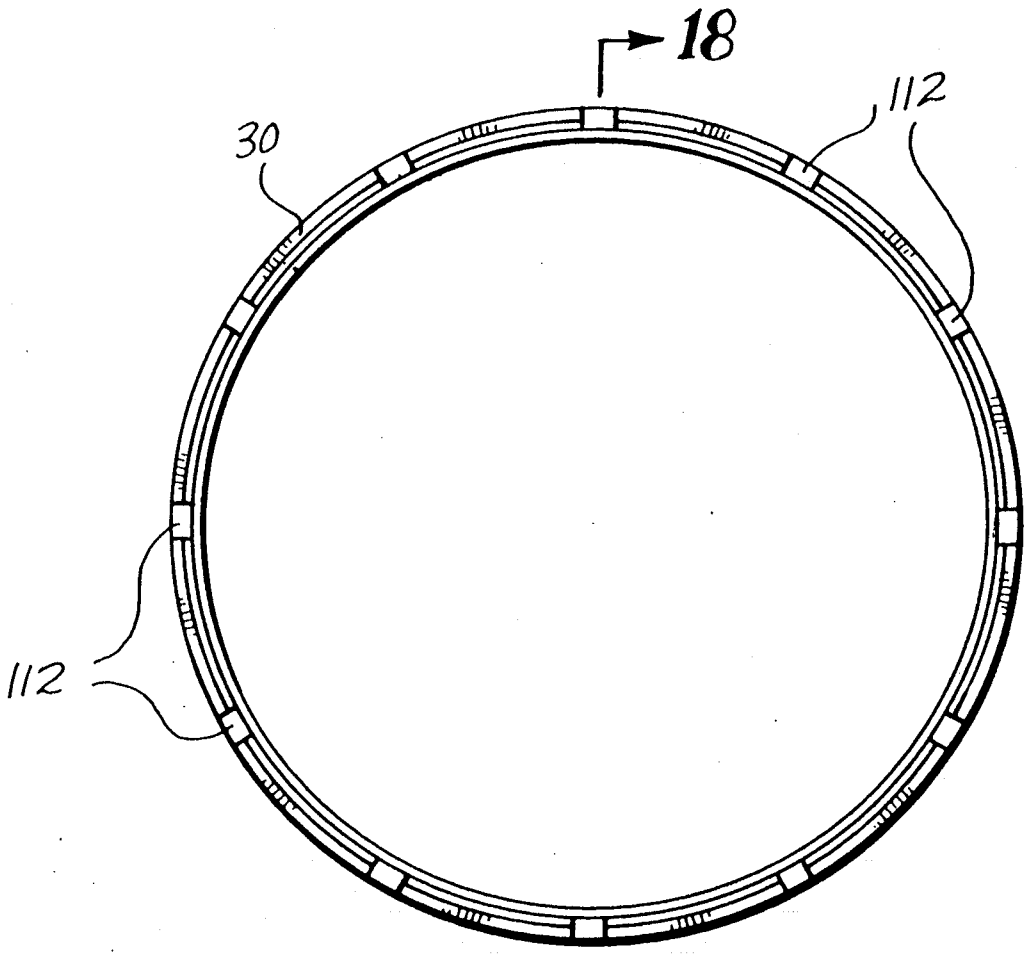
FIG. 17 is a plan view of the retaining nut.
Figure 18:
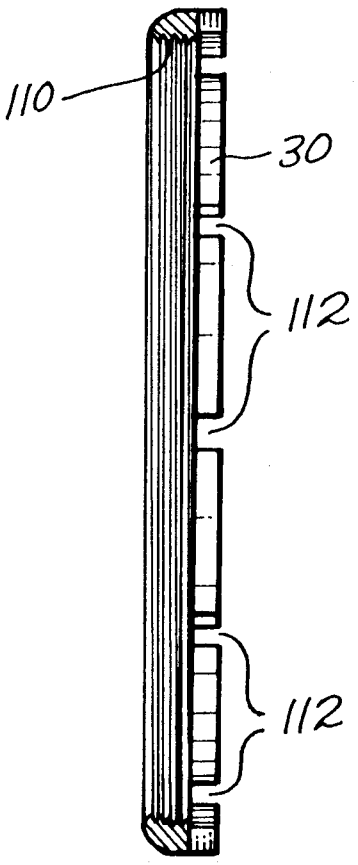
FIG. 18 is a sectional view of the retaining nut taken substantially along line 18—18 of FIG. 17.
Figure 26:
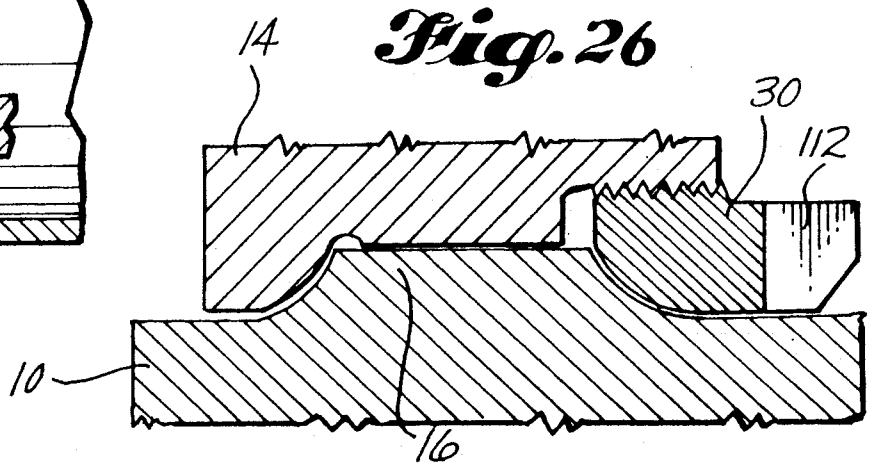
FIG. 26 is a detailed view showing the threaded engagement between the restrictor plate and retaining nut, both parts being seated against the annular lip inside the shook strut cylinder.

Once the restrictor plate 14 has been seated into the position shown in FIG. 15, the retaining nut 30 may be installed. The retaining nut 30, as illustrated in Figs. 17 and 18, may be a substantially-open ring sized to thread onto the restrictor plate 14, engaging the restrictor plate 14 against the annular bore lip 16 as shown in FIG. 26. The illustrated retaining nut 30 includes internal threads 110 and a plurality of circumferentially-spaced lug notches 112.

Referring now to FIGS. 19–24, the second tool piece 28 includes an elongated handle 32 having a proximal end 114 and a distal end 116. The handle 32 is a hollow tube sized to fit over the handle 24 and control knobs 20, 36 of the first tool piece 12. In this manner, the two tool pieces 12, 28 can become telescopically assembled.

A forked cage assembly 34 extends from the proximal end 116 of the handle 32. The cage assembly 34 includes a base 118 having projections extending radially outwardly from the handle 32 and a plurality of substantially parallel forks 120 which extend forwardly to a mounting ring 122. The cage assembly 34 is sized in both depth and diameter to provide clearance around the carriage assembly 24 and the pivotal head 40 with its crosshead pivoting mechanism 19. The mounting ring 122 includes a plurality of forwardly-extending lugs 124 which are spaced about the circumference of the mounting ring 122 to engage with notches 112 of the retaining nut 30. In preferred form, the lugs 124 are slightly undersized in width and include an elastomeric O-ring (not shown) seated in an edge groove of the lug 124. The slight compressibility of an elastomeric O-ring provides a firm frictional holding of the retaining nut 30 onto the cage assembly 34 for the intended uses of the tool. This also allows the tool to be easily disengaged from the retaining nut 30 once the nut 30 has been threaded onto the restrictor plate 14.

In preferred form, the cage assembly 34 is assembled with countersunk bolts as shown rather than be welding or otherwise. This type of assembly allows for fine adjustment and alignment with the use of shims, if necessary, and allows easy repair or adjustment in the event the tool is damaged or knocked out of alignment.

The handle 32 and cage assembly 34 is carried and held in an axially-centered position within the cylinder 10 by a pair of planetary roller housings 126, 128. These housings 126, 128 each include two sets of rollers. The first set includes four roller wheels 130 mounted in diametrically-opposed pairs to a planetary ring 132. The rollers 130 and ring 132 are sized and spaced to fit within the shock strut cylinder 10, contacting the interior surface at radial angles. The roller wheels 130 should be made of a non-marring material such as nylon or other thermoplastic material.

The planetary ring 132 includes an inner annular groove or track 134. The handle 32 is centered and mounted within the planetary ring 132 on bearings having planetary rollers 136 which travel within the groove 134 of the ring 132. In this manner, the handle 32 and the cage assembly 34 is freely rotatable within and supported by the planetary ring 132 on its first set of rollers 130. This construction is best illustrated in Figs. i9 and 21.

The two planetary roller housings 126, 128 are spaced apart on the handle 32 to assure axial alignment of the tool piece 28 within the cylinder 10 as it is being introduced into the cylinder 10 and during rotation of the handle 32 and cage assembly 34. In preferred form, the first roller housing 126 is positioned adjacent the base 118 of the cage assembly 34. The second roller housing 128 may be spaced rearwardly some distance and may be adjustable with a locking collet 138 of well-known construction. The exact position of the second roller housing 128 can be determined by the user in order to provide a preferred balance and feel of the tool piece 28 in use.

In use, the retaining nut 30 is frictionally mounted on the lugs 124 of the mounting ring 122 prior to introduction into the shook strut cylinder 10. The entire tool piece 28 with retaining nut 30 in place is then axially slid over the first tool piece 12 which has already been used to position and seat the restrictor plate 14. If desired, a guide rod 140, shown in FIG. 24, threaded into the second control knob 36 of the first tool piece 12 can be used to provide support and centering guidance while moving the second tool piece 28 into position. Many users will find the guiding rod 140 to be unnecessary.

Figure 19:
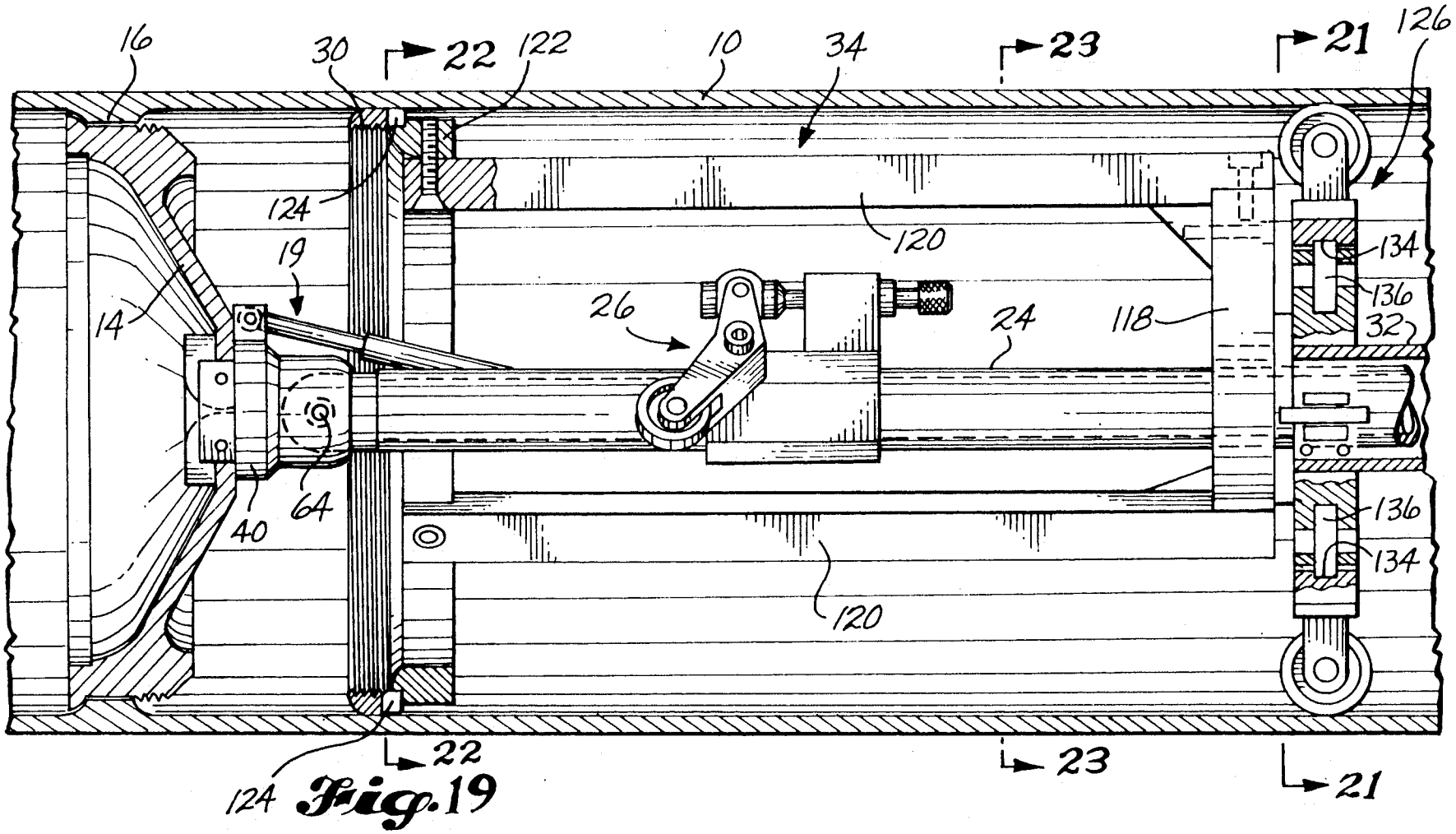
FIG. 19 is a fragmentary sectional detailed view similar to FIGS. 5–7 showing the restrictor plate seated against the annular lip and held by the first tool member and showing the distal end of the second tool member moving the retaining nut into place.
Figure 20:
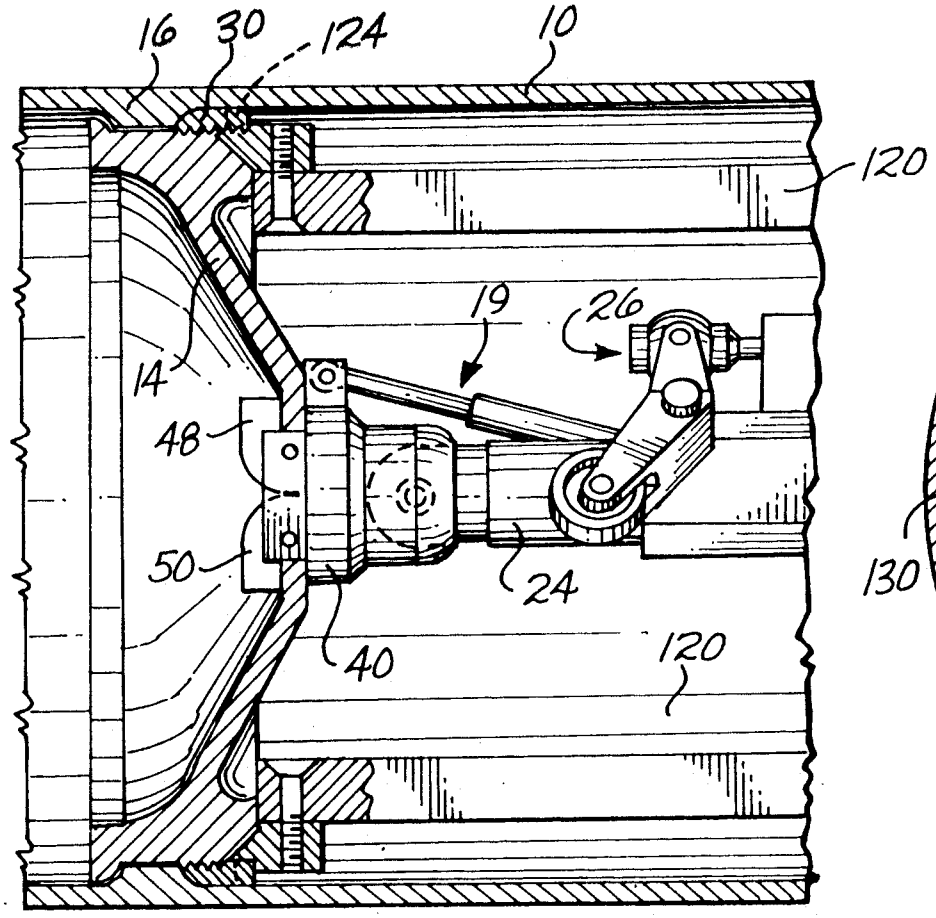
FIG. 20 is a view similar to FIG. 18, showing the threads of the retaining nut engaging the threads of the restrictor plate.
Figure 23:
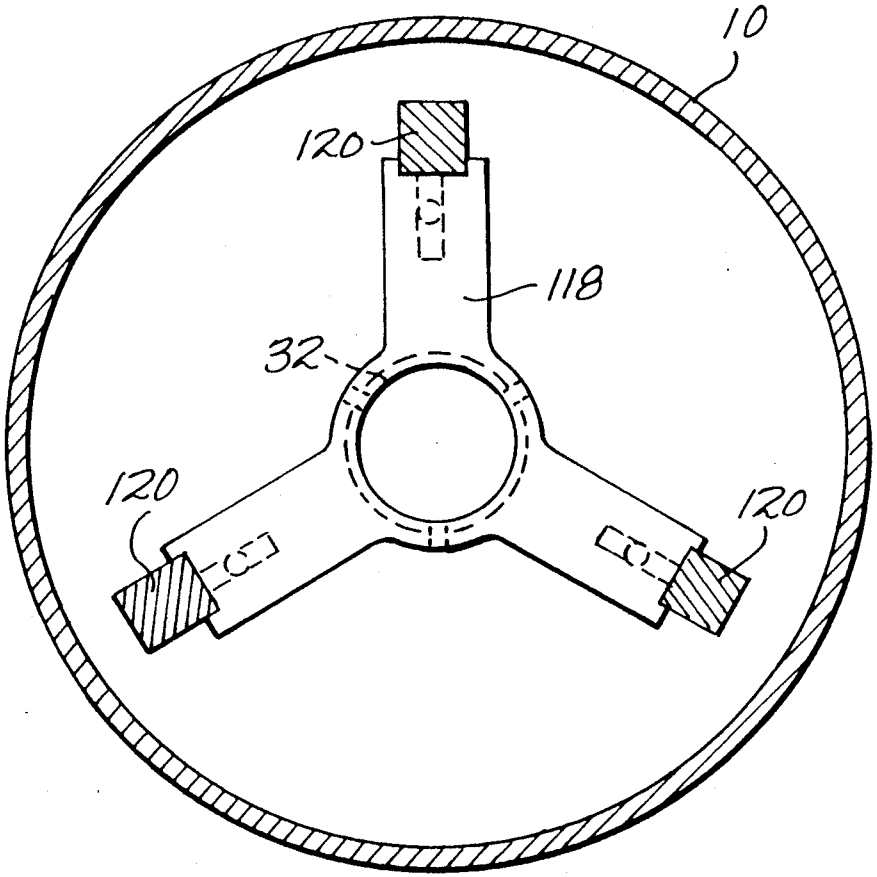
FIG. 23 is a sectional view taken substantially along line 23—23 of FIG. 19.
Figure 22:
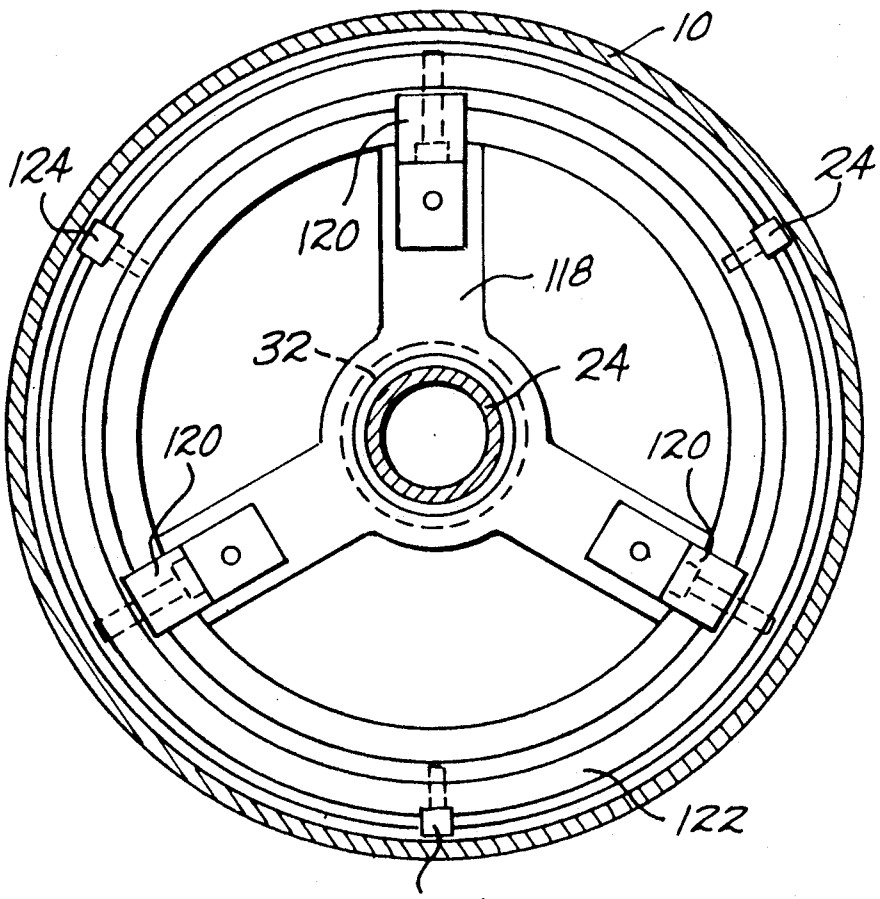
FIG. 22 is a sectional view taken substantially along line 22—22 of FIG. 19.
Figure 24:
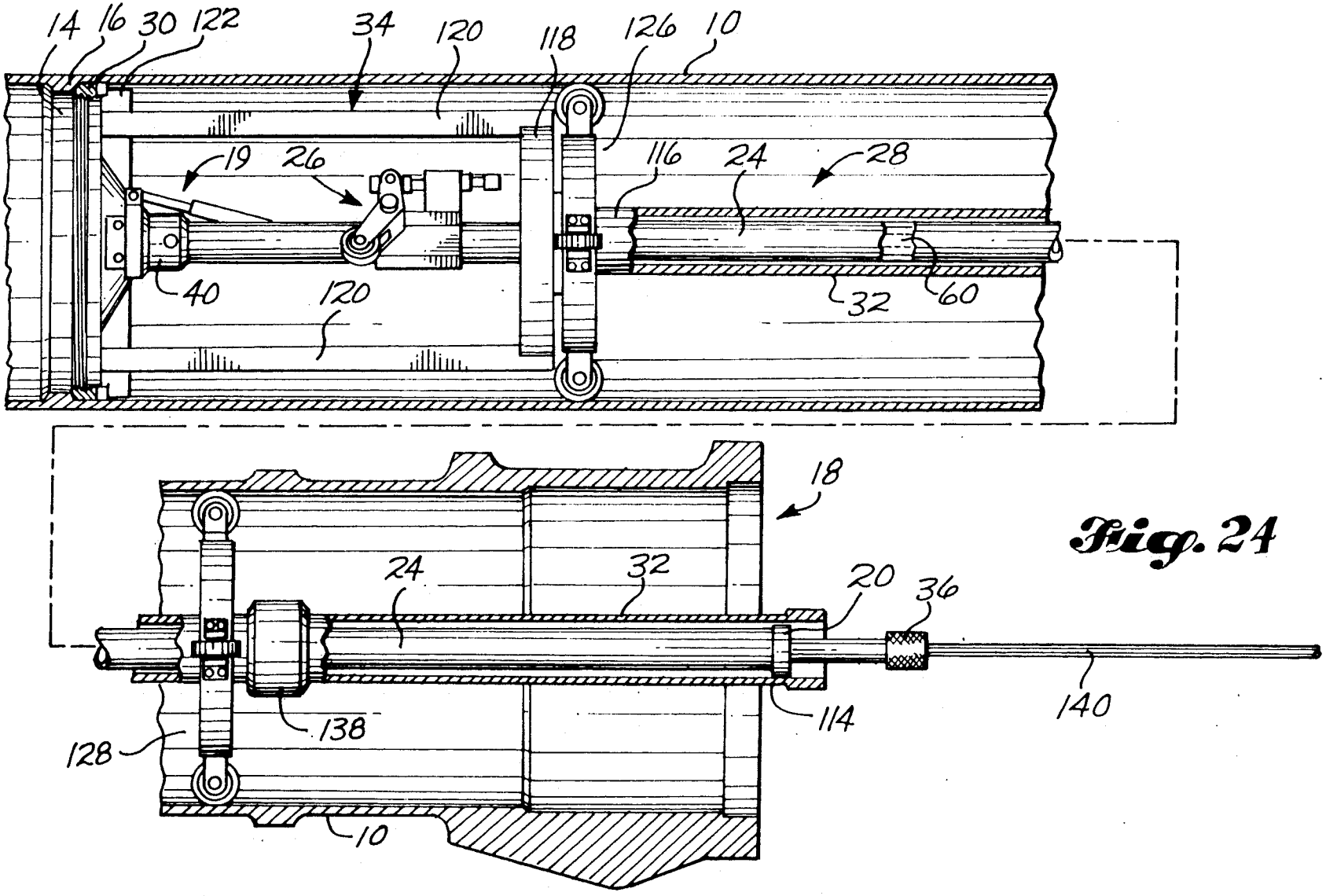
FIG. 24 is a broken, sectional view of the shock strut cylinder showing both portions of the present tool in place to thread the restrictor nut onto the restrictor plate.

The second tool piece 28 with the retaining nut 30 in place is then moved down the length of the cylinder 10 as shown in FIG. 19. Referring to FIG. 20, when the retaining nut 30 is in place against the threads of the restrictor plate 14, the handle 32 and cage assembly 34 is rotated on the planetary roller bearings 136 to thread the nut 30 onto the plate 14. Because the planetary roller assemblies 126, 128 provide very low friction bearings, the user can readily perceive a "feel" of the threads being aligned and engaging together. With very little training or acquired skill, the user can guide together the threads of the nut 30 and plate 14 without significant risk of cross-threading.

Once the retaining nut 30 is threaded lightly tight onto the restrictor plate 14, the function of the tool of the present invention is completed. To remove the tool pieces 12, 28 from the cylinder 10, the looking mechanism 25 of the first tool piece 12 must be released from the restrictor plate 14. This is accomplished by rotation of the control knob 36 at the proximal end 22 of the first tool piece 12. Rotation of the control knob 36 operates the control rod 60 and backs away the threaded plunger cam 54 through the now-aligned universal joint 62. As the threaded plunger cam 54 moves rearwardly, the engagement jaws 48, 50 are allowed to rotate inwardly as shown in FIG. 25. This releases the head 40 from the plate 14 to allow the tool part 12 to be axially pulled away from the plate 14. The frictional engagement of the mounting ring lugs 124 in the retaining nut notches 112 is overcome simply by a rearward pull. It is preferred that both tool parts 12, 28 be pulled away and removed from the cylinder 10 together. This will allow the first tool part 12 to be carried by the roller housings 126, 128 of the second tool piece 28.

The installation tool of the present invention is not intended to be used to tighten the retaining nut 30 to maximum torque. Torquing of the retaining nut 30 is performed by use of the previously-existing installation tool and torquing wrench 38 shown in FIGS. 4 and 27–29.

The torquing wrench 38 includes an elongated handle 142 with a handle 144 at its proximal end 146. At the distal end 148 of the handle 142 is a spanner 150 having forwardly-extending lugs 152 sized and spaced to engage in notches 112 of the retaining nut 30. A centering spider 154 is used to guide the wrench 38 into the cylinder 10 and to keep the handle 142 axially aligned therein. This wrench 38 is then used to tighten the retaining nut 30 to the required torque. The torquing wrench 38 is previously existing and does not constitute a part of the present invention. However, the torquing wrench 38 is required for complete installation of the restrictor plate 14 and retaining nut 30 when the installation tool of the present invention is used.

The illustrative, and therefore nonlimitive, apparatus shown in the various figures of the drawing may be altered in a variety of aspects to adapt it to particular applications without departing from the spirit and scope of the present invention. The illustrated embodiment is designed for use in the Boeing 747 outboard landing gear shock strut cylinder. Of course, some adaptations may be necessary for use with other sizes or styles of cylinders and/or restrictor plates. Patent protection is not to be limited by the above descriptions of preferred modes for practicing the invention or by the illustrated equipment, but rather by the following appended claim or claims as interpreted by accepted doctrines of claim interpretation, including the doctrine of equivalents.

What is claimed is:

1. A tool for installing a restrictor plate in a shock strut cylinder, comprising:

a first tool member having an elongated handle with proximal and distal ends and a longitudinal axis;

said distal end including controllable attachment means for providing an axially-centered locking grasp on a restrictor plate;

first control means operable by a user from said proximal end to control said attachment means;

said distal end including means for pivoting said restrictor plate between a first position and a second position relative to said longitudinal axis;

second control means operable by a user from said proximal end to control said pivoting means;

a second tool member having a hollow elongated handle with proximal and distal ends and being sized to axially telescope over the elongated handle of said first tool member;

said distal end including a cage means for holding and positioning a retaining nut;

said second tool member including a centering means for axially centering said tool member within said shock strut cylinder and bearing means for facilitating axial rotation of said hollow elongated handle, said cage means and said retaining nut relative to said first tool member and said shock strut cylinder.

2. A tool according to claim 1, wherein said first position of said restrictor plate is axially aligned relative to said longitudinal axis and said second position is axially transverse relative to said longitudinal $a_{xis}$.

3. A tool according to claim 2, wherein said first control means is locked from operation when said pivoting means is in said second position.

4. A tool according to claim 3, said pivoting means having pivot axis and said first control means being operable by rotational movement including a universal joint aligned with said pivot axis.

5. A tool according to claim 1, wherein said first control means is operable by rotational movement.

6. A tool according to claim 5, said pivoting means having an pivot axis and said first control means including a universal joint aligned with said pivot axis.

7. A tool according to claim 6, wherein said first control means includes further means for translation of said rotational movement into longitudinal movement for operation of said attachment means.

8. A tool according to claim wherein said second control means is operable by rotational movement and further includes means for translation of said rotational movement into longitudinal movement relative to said longitudinal axis and said longitudinal movement controlling a pivotal linkage connected to said pivoting means.

* * * * *

UNITED STATES PATENT AND TRADEMARK OFFICE

CERTIFICATE OF CORRECTION

PATENT NO. : 5,174,174

DATED : December 29, 1992

INVENTOR(S) : Monte L. Schroeder

It is certified that error appears in the above-identified patent and that said Letters Patent is hereby corrected as shown below:

Column 2, line 9, "cook" should be -- cock --.

Column 2, line 58, "out" should be -- cut --.

Column 3, line 16, "shook" should be -- shock --.

Column 3, line 35, after "throughout", insert -- the --.

Column 3, line 42, "shook" should be -- shock--.

Column 3, line 63, "out-away" should be -- cut-away --.

Column 4, line 4, after "restrictor ", insert -- plate being --.

Column 4, line 43, "shook" should be -- shock --.

Column 4, line 56, "out away" should be -- cut away --.

Column 4, line 57, "shook" should be -- shock --.

UNITED STATES PATENT AND TRADEMARK OFFICE

CERTIFICATE OF CORRECTION

PATENT NO. : 5,174,174

DATED : December 29, 1992

INVENTOR(S) : Monte L. Schroeder

It is certified that error appears in the above-identified patent and that said Letters Patent is hereby corrected as shown below:

Column 5, line 55, "shook" should be -- shock --.

Column 5, line 64, "looking" should be -- locking --.

Column 6, line 2, "looking" should be -- locking --.

Column 7, line 62, "shook" should be -- shock --.

Column 8, line 36, "interlooked" should be -- interlocked --.

Column 9, line 39, "Figs. i9" should be -- Figs. 19 --.

Column 9, line 56, "shook" should be -- shock --.

Column 10, line 13, "looking" should be -- locking --.

Claim 8, Column 12, line 19, after "claim", insert 1.

Signed and Sealed this

First Day of February, 1994

Bruce Lehman

BRUCE LEHMAN

*Commissioner of Patents and Trademarks*

*Attest:*

*Attesting Officer*